US008807690B2

(12) United States Patent
Murashima

(10) Patent No.: US 8,807,690 B2
(45) Date of Patent: Aug. 19, 2014

(54) TEST-PATTERN FORMING METHOD, COMPUTER READABLE MEDIUM FOR FORMING A TEST-PATTERN, AND PRINTER

(75) Inventor: Hiroshi Murashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 792 days.

(21) Appl. No.: 12/328,618

(22) Filed: Dec. 4, 2008

(65) Prior Publication Data

US 2009/0141068 A1 Jun. 4, 2009

(30) Foreign Application Priority Data

Dec. 4, 2007 (JP) ..... 2007-312976

(51) Int. Cl.
*B41J 29/393* (2006.01)

(52) U.S. Cl.
USPC ..... 347/19; 347/42

(58) Field of Classification Search
USPC ..... 347/19
See application file for complete search history.

(56) References Cited

U.S. PATENT DOCUMENTS

| | | | | |
|---|---|---|---|---|
| 5,644,344 | A * | 7/1997 | Haselby | 347/19 |
| 2002/0041299 | A1 | 4/2002 | Lee et al. | |
| 2005/0073539 | A1 * | 4/2005 | McGarry et al. | 347/14 |
| 2005/0122376 | A1 * | 6/2005 | Oishi | 347/40 |
| 2006/0214976 | A1 | 9/2006 | Iwao et al. | |
| 2009/0141078 | A1 * | 6/2009 | Kayahara et al. | 347/40 |

FOREIGN PATENT DOCUMENTS

| | | | |
|---|---|---|---|
| JP | 2002-178505 | A | 6/2002 |
| JP | 2005-186404 | A | 7/2005 |
| JP | 2005-193654 | A | 7/2005 |
| JP | 2006-007616 | A | 1/2006 |
| JP | 2006-123291 | A | 5/2006 |
| JP | 2006-264041 | A | 10/2006 |
| JP | 2007-007882 | A | 1/2007 |
| JP | 2007-029786 | A | 2/2007 |
| JP | 2007-044967 | A | 2/2007 |
| JP | 2007-230090 | A | 9/2007 |

OTHER PUBLICATIONS

Japan Patent Office, Notice of Reasons for Rejection for Japanese Patent Application No. 2007-312976 (counterpart to above-captioned patent application), mailed Nov. 22, 2011.
Japan Patent Office, Decision to Grant a Patent for Japanese Patent Application No. 2007-312976 (counterpart to above-captioned patent application), mailed Apr. 3, 2012.

* cited by examiner

*Primary Examiner* — Uyen Chau N Le
*Assistant Examiner* — Chad Smith
(74) *Attorney, Agent, or Firm* — Baker Botts L.L.P.

(57) ABSTRACT

A method of forming a test pattern in a printer, wherein the printer may include at least one liquid discharge head including a nozzle plate, and the nozzle plate has a plurality of nozzles formed therethrough, wherein the plurality of nozzles are configured to discharge a liquid and are arranged in a plurality of rows which are parallel to each other and extend in a particular direction, the method may comprise the steps of selecting a first nozzle of the plurality of nozzles from a first row of the plurality of rows, selecting a second nozzle of the plurality of nozzles from a second row of the plurality of rows, and discharging the liquid from the first nozzle and from the second nozzle onto a medium, wherein a third row of the plurality of rows is positioned between the first row and the second row.

11 Claims, 19 Drawing Sheets

TEST-PATTERN FORMING METHOD, COMPUTER READABLE MEDIUM FOR FORMING A TEST-PATTERN, AND PRINTER

CROSS REFERENCE TO RELATED APPLICATION

This application claims priority to and the benefit of Japanese Patent Application No. 2007-312976, filed Dec. 4, 2007, the entire subject matter and disclosure of which are incorporated herein by reference.

BACKGROUND OF THE DISCLOSURE

1. Field of the Disclosure

The present invention relates to a method of forming a test pattern in a printer, a computer readable medium bearing instructions for forming a test pattern in a printer, and a printer that forms a test pattern.

2. Description of the Related Art

A known printer forms a test pattern by discharging ink from a plurality of nozzles of a head unit towards a recording medium being conveyed. The test pattern consists of multiple lines extending in the conveying direction of the recording medium.

With respect to the inkjet head having a plurality of discharge nozzles arranged in a matrix, the following description is directed to a case where the test pattern is supposedly formed in order to check for misalignment between the orthogonal direction orthogonal to the multiple rows formed on the discharge face of the inkjet head and a sub scanning direction corresponding to the conveying direction of sheets. In this case, if two adjacent lines of the multiple lines formed as a test pattern are formed with ink discharged from two discharge nozzles respectively belonging to two adjacent rows, the distance separating the two discharge nozzles from each other in the orthogonal direction is extremely short. This implies that a variation in the distance between the two lines is small with respect to the degree of misalignment between the sub scanning direction and the orthogonal direction, thus resulting in extremely low detection accuracy for the misalignment.

SUMMARY OF THE INVENTION

A need has arisen for a method of forming a test pattern, a computer readable medium bearing instructions for forming a test pattern, and a printer that forms a test pattern allowing for highly accurate detection of misalignment between the sub scanning direction and the orthogonal direction orthogonal to the rows of discharge nozzles arranged in the one direction.

According to one embodiment herein, a method of forming a test pattern in a printer, wherein the printer may comprise at least one liquid discharge head comprising a nozzle plate, and the nozzle plate has a plurality of nozzles formed therethrough, wherein the plurality of nozzles are configured to discharge a liquid and are arranged in a plurality of rows which are parallel to each other and extend in a particular direction, the method may comprise the steps of selecting a first nozzle of the plurality of nozzles from a first row of the plurality of rows, selecting a second nozzle of the plurality of nozzles from a second row of the plurality of rows; and discharging the liquid from the first nozzle and from the second nozzle onto a medium, wherein a third row of the plurality of rows is positioned between the first row and the second row.

According to another embodiment herein, a computer readable medium bearing instructions for forming a test pattern in a printer which may comprise at least one liquid discharge head comprising a nozzle plate, and the nozzle plate has a plurality of nozzles formed therethrough, wherein the plurality of nozzles are configured to discharge a liquid and are arranged in a plurality of rows which are parallel to each other and extend in a particular direction, the instructions, when executed, being arranged to cause a processing arrangement to perform the steps of selecting a first nozzle of the plurality of nozzles from a first row of the plurality of rows, selecting a second nozzle of the plurality of nozzles from a second row of the plurality of rows; and discharging the liquid from the first nozzle and from the second nozzle onto a medium, wherein a third row of the plurality of rows is positioned between the first row and the second row.

According to another embodiment herein, a printer may comprise at least one liquid discharge head comprising a nozzle plate, and the nozzle plate has a plurality of nozzles formed therethrough, wherein the plurality of nozzles are configured to discharge a liquid and are arranged in a plurality of rows which are parallel to each other and extend in a particular direction, and discharge controller that is configured to perform the step of selecting a first nozzle of the plurality of nozzles from a first row of the plurality of rows, the step of selecting a second nozzle of the plurality of nozzles from a second row of the plurality of rows, and the step of discharging the liquid from the first nozzle and from the second nozzle onto a medium, wherein a third row of the plurality of rows is positioned between the first row and the second row.

Other objects, features and advantages will be apparent to those skilled in the art from the following detailed descriptions and accompanying drawings.

DESCRIPTION OF THE EMBODIMENTS

Various embodiments, and their features and advantages, may be understood by referring to FIGS. 1-19, like numerals being used for corresponding parts in the various drawings.

One Embodiment

Figure 1:
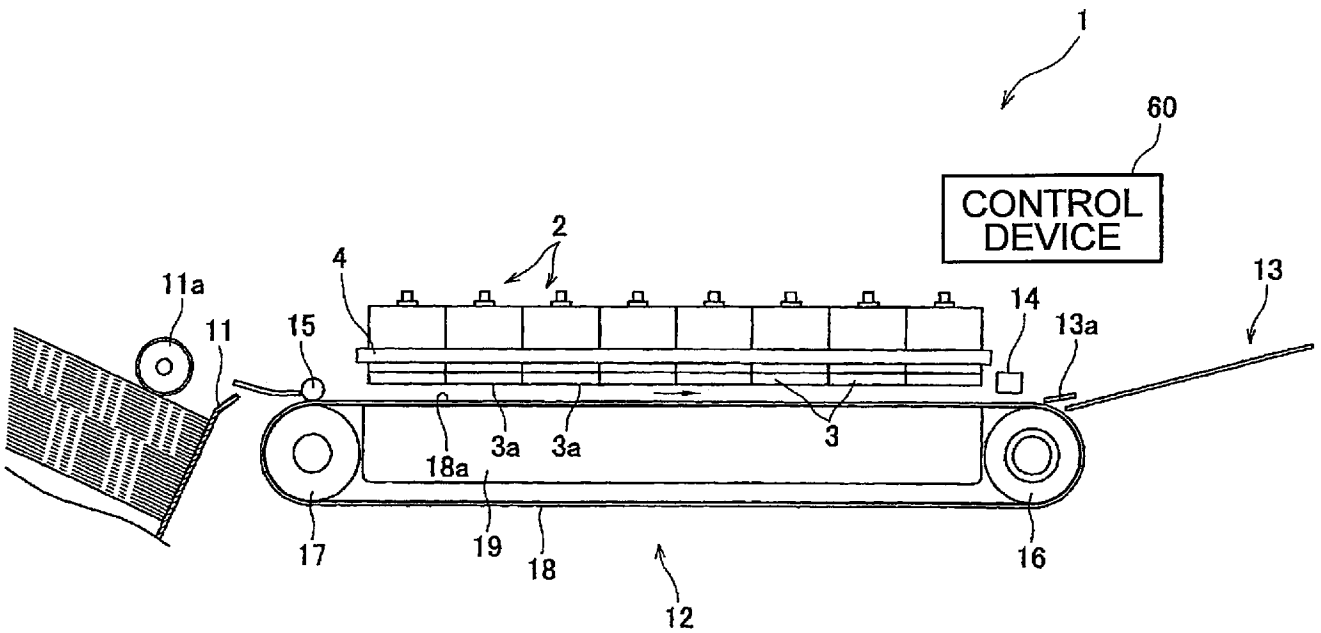
FIG. 1 is a schematic side view showing the overall configuration of a printer according to an embodiment.
Figure 2:
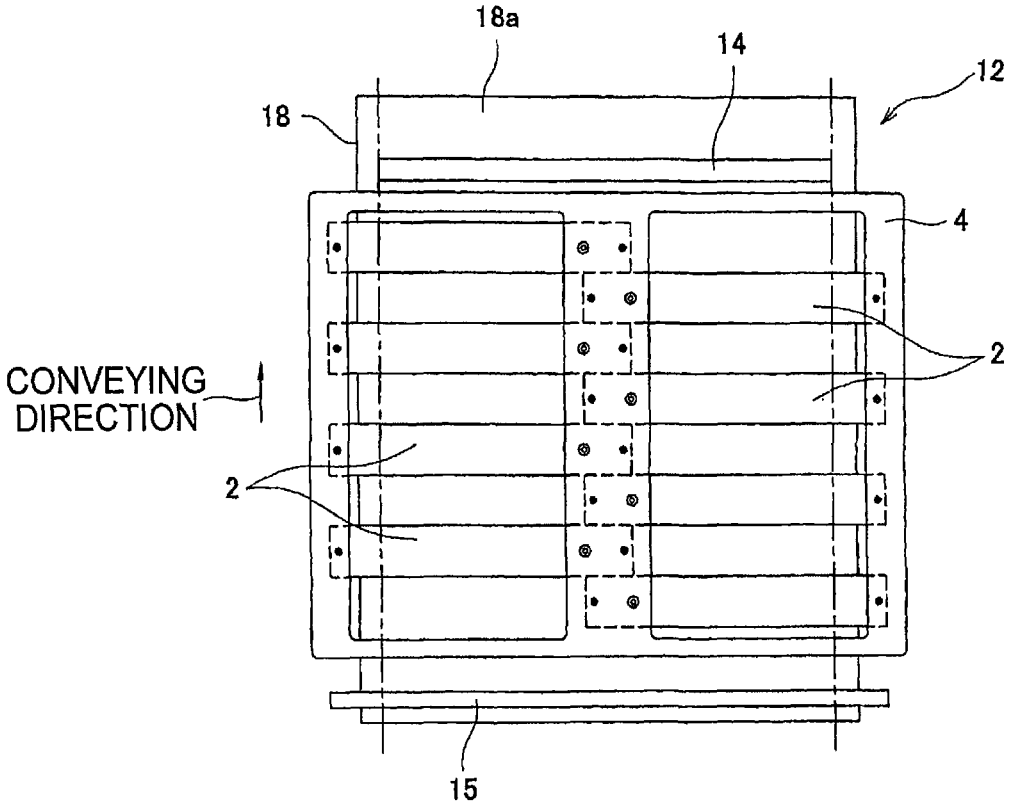
FIG. 2 is a schematic plan view of relevant part of the printer shown in FIG. 1.

Referring to FIGS. 1 and 2, a printer 1 is a color inkjet printer having a plurality of inkjet heads 2. The printer 1 has a conveying mechanism 12 disposed below the inkjet heads 2. This conveying mechanism 12 is configured to convey a sheet fed from a feed tray 11 by a pickup roller 11*a* in a direction of an arrow shown in FIG. 1 (i.e. a direction from left to right in FIG. 1 which will be referred to as "conveying direction" or "sheet conveying direction" hereinafter).

The conveying mechanism 12 includes two belt rollers 16 and 17 and an endless conveying belt 18 bridged between the belt rollers 16 and 17. Of the two belt rollers 16 and 17 shown in FIG. 1, the belt roller at the downstream side in the conveying direction, namely, the belt roller 16 positioned on the right-hand side, can be rotatably driven clockwise by a driving motor (not shown). A platen 19 having a substantially rectangular parallelepiped shape is disposed within the inner area of the endless conveying belt 18 and supports the conveying belt 18 from the inner side thereof. A pressing roller 15 is disposed immediately downstream of the feed tray 11 at a position facing the conveying belt 18. The pressing roller 15 is configured to press a sheet fed from the feed tray 11 against a conveying face 18*a* of the conveying belt 18.

A catch tray 13 is disposed downstream of the conveying mechanism 12 in the conveying direction. The conveying belt 18 and the catch tray 13 have a separating member 13*a* disposed therebetween. The separating member 13*a* is configured to separate a sheet held on the conveying face 18*a* of the conveying belt 18 from the conveying face 18*a* and to guide the separated sheet towards the catch tray 13.

Each inkjet head 2 has a narrow rectangular parallelepiped shape that is long in one direction. The lengthwise and widthwise directions of an inkjet head 2 in plan view will simply be referred to as "lengthwise direction" and "widthwise direction" hereinafter. The printer 1 according to this embodiment is equipped with two inkjet heads 2 for each of four color inks (magenta, yellow, cyan, and black), which means that there are a total of eight inkjet heads 2. The eight inkjet heads 2 are arranged in a zigzag pattern to form two rows in plan view, and are fixed to a frame 4. In other words, the printer 1 is a line printer.

More specifically, the eight inkjet heads 2 are disposed side by side in the widthwise direction, and each pair of inkjet heads 2 corresponding to the same color ink are disposed next to each other in the widthwise direction while partially abutting each other in the widthwise direction at the longitudinal ends thereof. Each pair of inkjet heads 2 corresponding to the same color ink covers the entire width of the maximum area to be occupied by a sheet placed on the conveying face 18*a* of the conveying belt 18 (i.e. an area between the dot-dash lines in FIG. 2).

Each inkjet head 2 has a head body 3 at the lower side thereof. The bottom face of each head body 3 faces the conveying face 18*a* of the conveying belt 18 and has discharge-nozzle regions 3*a* with multiple ink discharge nozzles 8 arranged therein (see FIG. 6). As the sheet conveyed by the conveying belt 18 sequentially passes just below the eight head bodies 3, the ink discharge nozzles 8 discharge ink droplets of the respective colors toward the top face, i.e. the print face, of the sheet, thereby forming a desired color image on the print face of the sheet.

A detection device 14 is disposed downstream of the inkjet heads 2 in the conveying direction. The detection device 14 is configured to detect whether there are ink discharge defects caused by, for example, ink clogs in any of the multiple ink discharge nozzles 8 in each inkjet head 2. Specifically, the detection device 14 includes a light source (not shown) that emits light towards a sheet passing therebelow, and a contact image sensor (CIS) (not shown) that receives the light reflected from the sheet. The detection device 14 is capable of detecting whether there are any void sections in a test pattern image formed as a result of ink discharged onto the sheet from the ink discharge nozzles 8 of the inkjet heads 2.

The printer 1 is equipped with a control device 60 that controls the operation of the printer 1. The control device 60 may include, for example, a general-purpose personal computer. The computer contains hardware such as a central processing unit (CPU), read-only memory (ROM), random-access memory (RAM), and hard disk drive. The hard disk drive stores various software programs including, for example, a program for forming test patterns.

Figure 3:
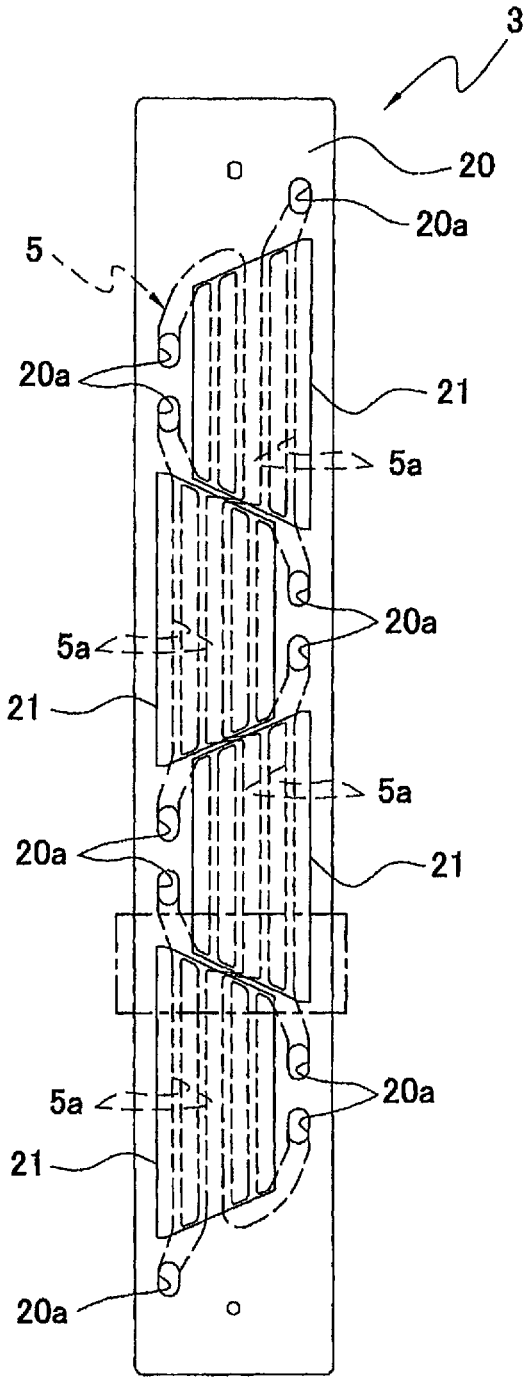
FIG. 3 is a plan view of one of head bodies.

Referring to FIG. 3, the head body 3 includes a flow channel unit 20 having a rectangular shape in plan view and four trapezoidal actuator units 21 fixed in a zigzag arrangement on the top face of the flow channel unit 20. More specifically, the four actuator units 21 are arranged on the top face of the flow channel unit 20 such that the upper side (i.e. upper base of trapezoid) and the lower side (i.e. lower base of trapezoid) of each actuator unit 21 are aligned with the lengthwise direction of the flow channel unit 20 and that the oblique sides of each adjacent pair of actuator units 21 extend parallel to each other and are at the same position with respect to the lengthwise direction. An inkjet head 2 is formed by combining this head body 3 with an ink-supplying reservoir unit (not shown) and with a driver integrated-circuit (IC) that generates a driving signal for driving the actuator units 21.

Figure 4:
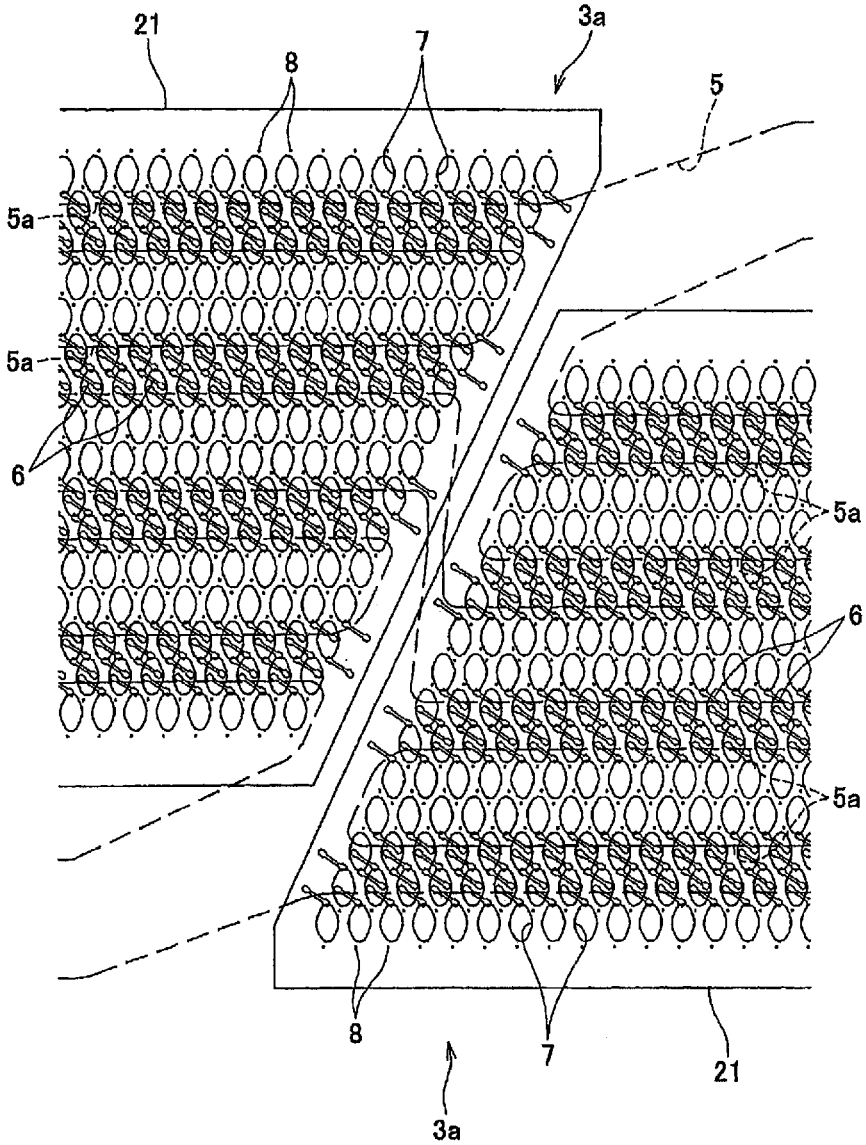
FIG. 4 is an enlarged view of a region surrounded by a dot-dash line in FIG. 3.

Referring to FIG. 4, the regions on the bottom face of the flow channel unit 20 that correspond to the respective actuator units 21 serve as the aforementioned discharge-nozzle regions 3*a*. Specifically, in a region opposed to an actuator unit 21, a plurality of ink discharge nozzles 8 are arranged in a matrix. On the top face of the flow channel unit 20, a plurality of pressure chambers 7 are provided, which communicate with the respective ink discharge nozzles 8. One actuator unit 21 covers multiple pressure chambers 7. Each actuator unit 21 includes a plurality of actuators in correspondence with respective pressure chambers 7 and has a function of applying discharge energy selectively to the ink in the pressure chambers 7.

Figure 5:
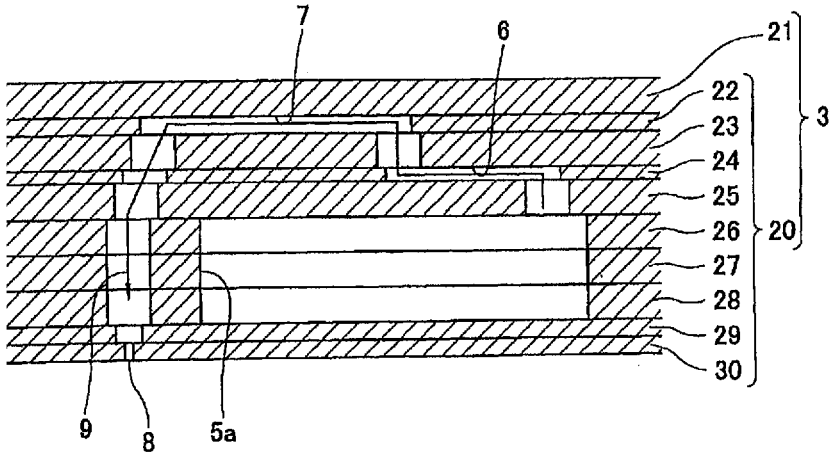
FIG. 5 is a partial cross-sectional view of the head body shown in FIG. 3.

Referring back to FIG. 3, the top face of the flow channel unit 20 has a total of ten ink supply ports 20*a* in correspondence with ink discharge channels (not shown) of the reservoir unit. The flow channel unit 20 has therein manifold channels 5 communicating with the corresponding ink supply ports 20*a*, and sub manifold channels 5*a* branching off from each manifold channel 5 and extending in the lengthwise direction, as shown in FIG. 3. Moreover, as shown in FIG. 5, the flow channel unit 20 also has therein individual ink channels 9, each extending from the corresponding sub manifold channels 5*a* to the corresponding ink discharge nozzle 8 via corresponding aperture 6 and pressure chamber 7. Accordingly, the ink from the reservoir unit can be supplied to the manifold channels 5 through the ink supply ports 20*a* and then distributed to the pressure chambers 7. When the actuator units 21 selectively applies discharge energy to the pressure chambers 7, the pressure of the ink in the pressure chambers 7 rises, thereby causing the ink to be discharged through the ink discharge nozzles 8 communicating with the pressure chambers 7.

Referring back to FIG. 4, in each region opposed to an actuator unit 21, there are four sub manifold channels 5*a* extending in the lengthwise direction and arranged at equal intervals in the widthwise direction. In addition, each region opposed to an actuator unit 21 also has pressure-chamber arrays, each array including a plurality of pressure chambers 7 arranged at equal intervals in the lengthwise direction. In detail, four regions respectively opposed to the four sub manifold channels 5*a* are each provided with two pressure-chamber arrays, and each pair of these pressure-chamber arrays are sandwiched between two pressure-chamber arrays, which means that there are a total of 16 pressure-chamber arrays. The ink discharge nozzles 8 communicating with the pressure chambers 7 are all formed in regions not opposed to the sub manifold channels 5*a*.

Referring to FIG. 5, the flow channel unit 20 has a multilayer structure that includes, from top to bottom, a cavity plate 22, a base plate 23, an aperture plate 24, a supply plate 25, manifold plates 26, 27, and 28, a cover plate 29, and a nozzle plate 30. This implies that the discharge-nozzle regions 3*a* with arrays of ink discharge nozzles 8 are formed on the bottom face of the nozzle plate 30. The plates 22 to 30 are metallic plates of, for example, stainless steel, and are stacked one on top of the other while being positioned with respect to each other so that the manifold channels 5, the sub manifold channels 5*a*, and the individual ink channels 9 extending from the outlets of the sub manifold channels 5*a* to the ink discharge nozzles 8 via the apertures 6 and the pressure chambers 7 can be properly formed in a plurality.

Figure 6:
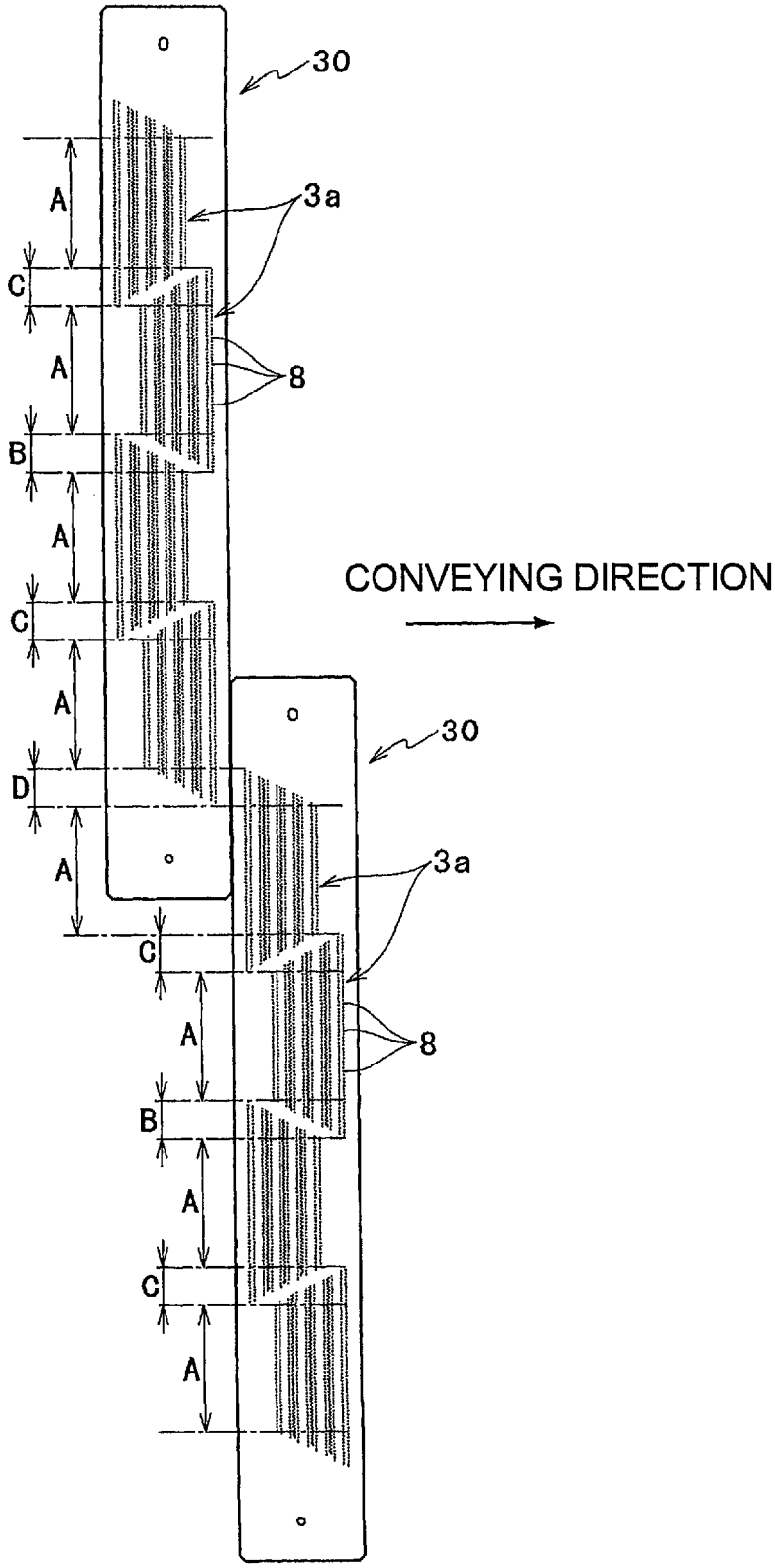
FIG. 6 is a bottom view of nozzle plates included in an adjacent pair of inkjet heads corresponding to the same color ink.

Referring to FIG. 6, the arrangement of ink discharge nozzles 8 will be described. In the description below, the nozzle plate 30 of the inkjet head 2 located at the downstream side in the conveying direction (i.e. right-hand side in FIG. 6) will be referred to as a "first nozzle plate", and the nozzle plate 30 of the inkjet head 2 located at the upstream side in the conveying direction (i.e. left-hand side in FIG. 6) will be referred to as a "second nozzle plate".

Each nozzle plate 30 has four discharge-nozzle regions 3*a* arranged in a zigzag pattern in the lengthwise direction so as to form two rows, each discharge-nozzle region 3*a* having multiple ink discharge nozzles 8 arranged in a matrix. Specifically, two of the four discharge-nozzle regions 3*a* are slightly positioned towards one side in the widthwise direction (towards the right in FIG. 6) while the other two are slightly positioned towards the other side in the widthwise direction (towards the left in FIG. 6). The inkjet heads 2 are installed in the printer 1 in a manner such that the left side of the nozzle plates 30 in FIG. 6 faces upstream and the right side faces downstream as viewed in the conveying direction. In the description below, a discharge-nozzle region 3*a* disposed closer towards the downstream side in each nozzle plate 30 will be referred to as a "first discharge-nozzle region", while a discharge-nozzle region 3*a* disposed closer towards the upstream side in each nozzle plate 30 will be referred to as a "second discharge-nozzle region", as viewed in the conveying direction.

The discharge-nozzle regions 3*a* are positioned in regions opposed to the actuator units 21. In other words, the discharge-nozzle regions 3*a* have substantially the same trapezoidal shape as the actuator units 21 in plan view, and are arranged such that the upper base and the lower base of each trapezoidal discharge-nozzle region 3*a* extend along the lengthwise direction. In addition, the oblique sides of each adjacent pair of discharge-nozzle regions 3*a* extend parallel to each other and are at the same position with respect to the lengthwise direction.

The first and second nozzle plates are disposed to partially abut each other such that the oblique sides of discharge-nozzle regions 3*a* disposed opposite to each other with respect to the lengthwise direction extend parallel to each other and are at the same position with respect to the lengthwise direction. More specifically, a second discharge-nozzle region of the first nozzle plate (at the right-hand side in FIG. 6) partially overlaps a first discharge-nozzle region of the second nozzle plate (at the left-hand side in FIG. 6) with respect to the widthwise direction (i.e. horizontal direction in FIG. 6). In this case, the first and second nozzle plates are arranged such that the lower bases of the opposing discharge-nozzle regions 3*a* are disposed in a back-to-back fashion.

The bottom faces of the first and second nozzle plates are divided into a plurality of areas arranged in the lengthwise direction. These areas can be sorted into four kinds of areas A to D. Area A only includes ink discharge nozzles 8 of one discharge-nozzle region 3*a*. Each of areas B and C includes ink discharge nozzles 8 of an adjacent pair of discharge-nozzle regions 3*a* within a nozzle plate 30. In area B, the parallel oblique sides of adjacent discharge-nozzle regions 3*a* rises from right to left in FIG. 6, whereas the parallel oblique sides of adjacent discharge-nozzle regions 3*a* in area C rises from left to right in FIG. 6. Area D covers both first and second nozzle plates and includes ink discharge nozzles 8 of the two discharge-nozzle regions 3*a* respectively of the first and second nozzle plates that partially overlap each other with respect to the widthwise direction.

Figure 7:
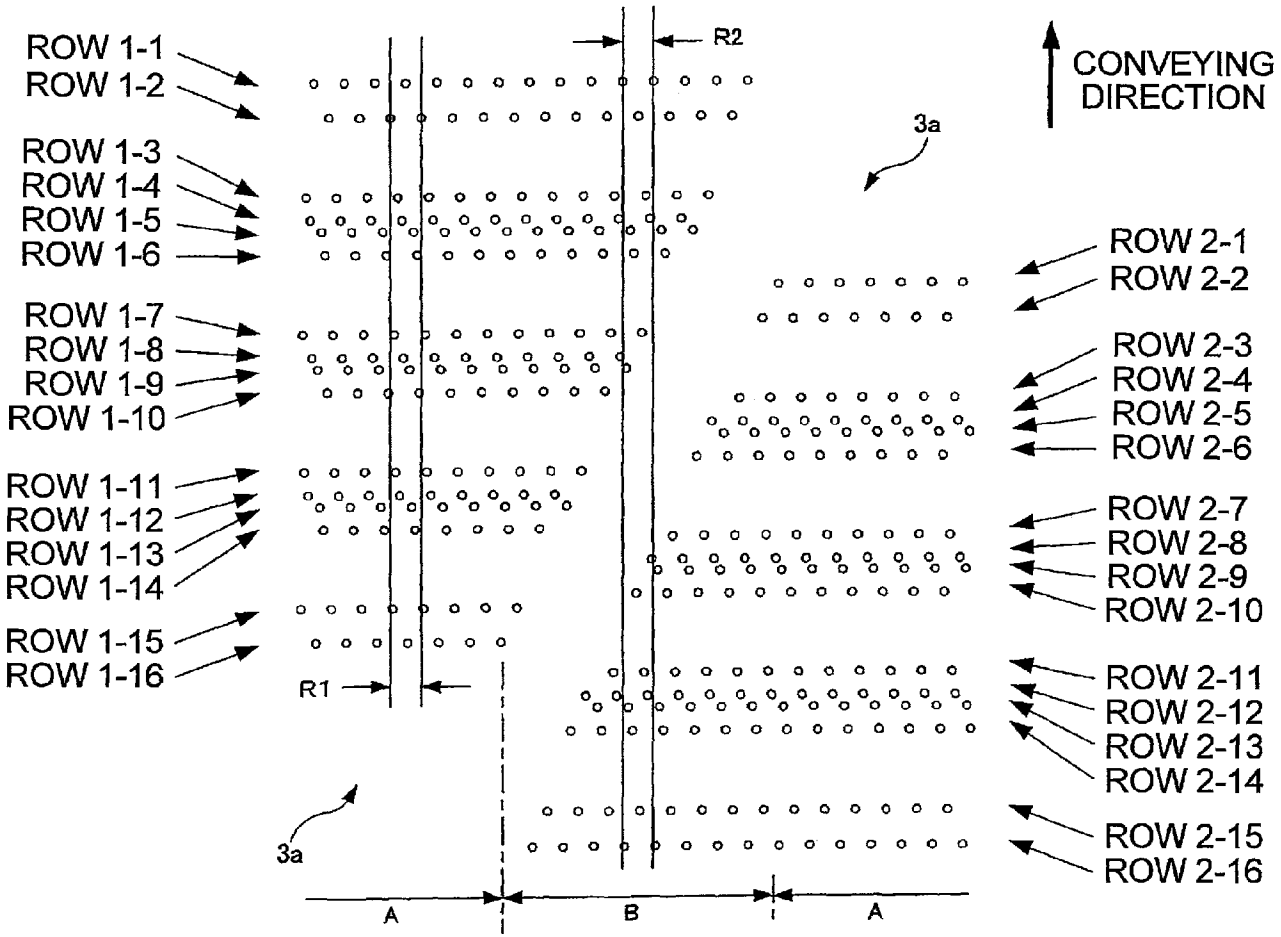
FIG. 7 is an enlarged view of area B shown in FIG. 6 and its surrounding areas.

Referring to FIG. 7, the ink discharge nozzles 8 in each discharge-nozzle region 3*a* form multiple rows extending in the lengthwise direction (i.e. horizontal direction in FIG. 7). In each discharge-nozzle region 3*a*, there are 16 rows that are arranged in the widthwise direction (i.e. vertical direction in FIG. 7), and as mentioned above, these rows of ink discharge nozzles 8 are formed in regions not opposed to the sub manifold channels 5*a*. In the description below, the 16 rows arranged within the first discharge-nozzle region located at the left side in FIG. 7 will be referred to as "row 1-1, row 1-2, . . . row 1-16" in that order from top to bottom. Likewise, the 16 rows arranged within the second discharge-nozzle region located at the right side in FIG. 7 will be referred to as "row 2-1, row 2-2, . . . row 2-16" in that order from top to bottom.

The ink discharge nozzles 8 are arranged in the lengthwise direction while being equally spaced apart from each other by a distance corresponding to 37.5 dpi. The number of ink discharge nozzles 8 included in each row is determined in accordance with the trapezoidal shape of the discharge-nozzle region 3*a*, such that the number of ink discharge nozzles 8 gradually decreases from the longer base towards the shorter base of the trapezoid.

In each of areas A to D, a unit zone defined by a characteristic arrangement pattern of ink discharge nozzles 8 is set as follows. From each unit zone, ink discharge nozzles 8 to be used for test pattern formation that are suitable for that unit zone are determined on the basis of the arrangement pattern.

For example, in area A, an elongate zone R1 is defined between two lines that extend in the widthwise direction and intersect with two adjacent ink discharge nozzles 8 of the plurality of ink discharge nozzles 8 belonging to the row 1-2. In addition to the two adjacent ink discharge nozzles 8 belonging to the row 1-2, the elongate zone R1 includes one ink discharge nozzle 8 from each of the remaining 15 rows excluding the row 1-2.

In area B, an elongate zone R2 is defined between two lines that extend in the widthwise direction and intersect with two adjacent ink discharge nozzles 8 of the plurality of ink discharge nozzles 8 belonging to the row 1-1. In addition to the two adjacent ink discharge nozzles 8 belonging to the row 1-1, the elongate zone R2 includes one ink discharge nozzle 8 from each of 15 rows, namely, one ink discharge nozzle 8 from each of six rows from the rows 1-2 to 1-7 in the first discharge-nozzle region, one ink discharge nozzle 8 from the row 1-9 in the first discharge-nozzle region, one ink discharge nozzle 8 from the row 2-8 in the second discharge-nozzle region, and one ink discharge nozzle 8 from each of seven rows from the rows 2-10 to 2-16 in the second discharge-nozzle region.

Figure 8:
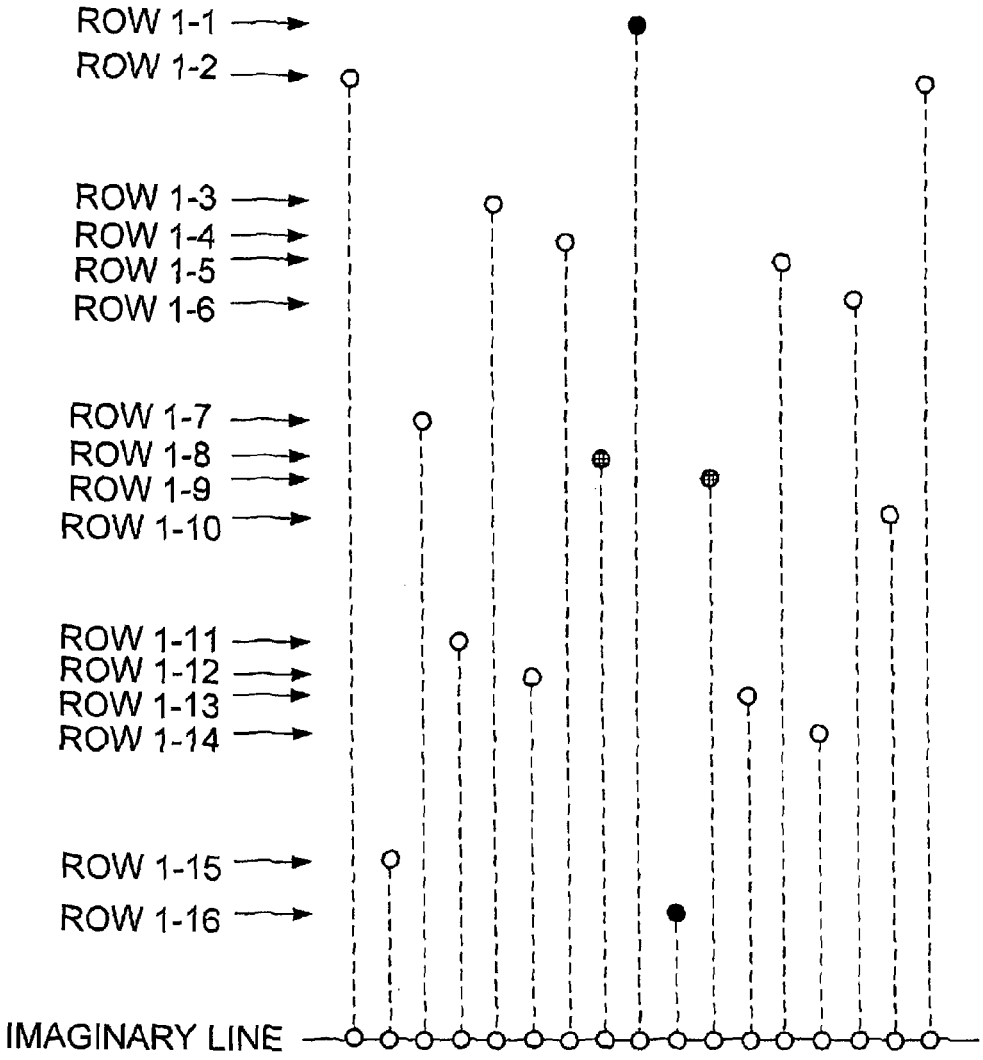
FIG. 8 is an enlarged view showing the positional relationships among ink discharge nozzles located within an elongate zone R1 shown in FIG. 7.

Referring to FIG. 8, the 17 ink discharge nozzles 8 are projected onto an imaginary line, which extends in the lengthwise direction (horizontal direction in FIG. 8), from the widthwise direction orthogonal to this imaginary line. The resulting adjacent projective points are equally spaced apart from each other by a distance corresponding to 600 dpi. Accordingly, by appropriately driving the actuator units 21 while conveying a sheet in a direction aligned with the widthwise direction, images such as characters and drawings can be rendered with a resolution of 600 dpi. FIG. 8 is shown at different scales between the vertical and horizontal directions.

In each discharge-nozzle region 3*a*, the ink discharge nozzles 8 are arranged in a consistent pattern that repeats for every width of the elongate zone R1. In other words, the arrangement pattern of ink discharge nozzles 8 within an elongate zone R1 is consistent as long as the row that includes the ink discharge nozzles 8 with which the border lines of the elongate zone R1 intersect is consistent.

Figure 9:
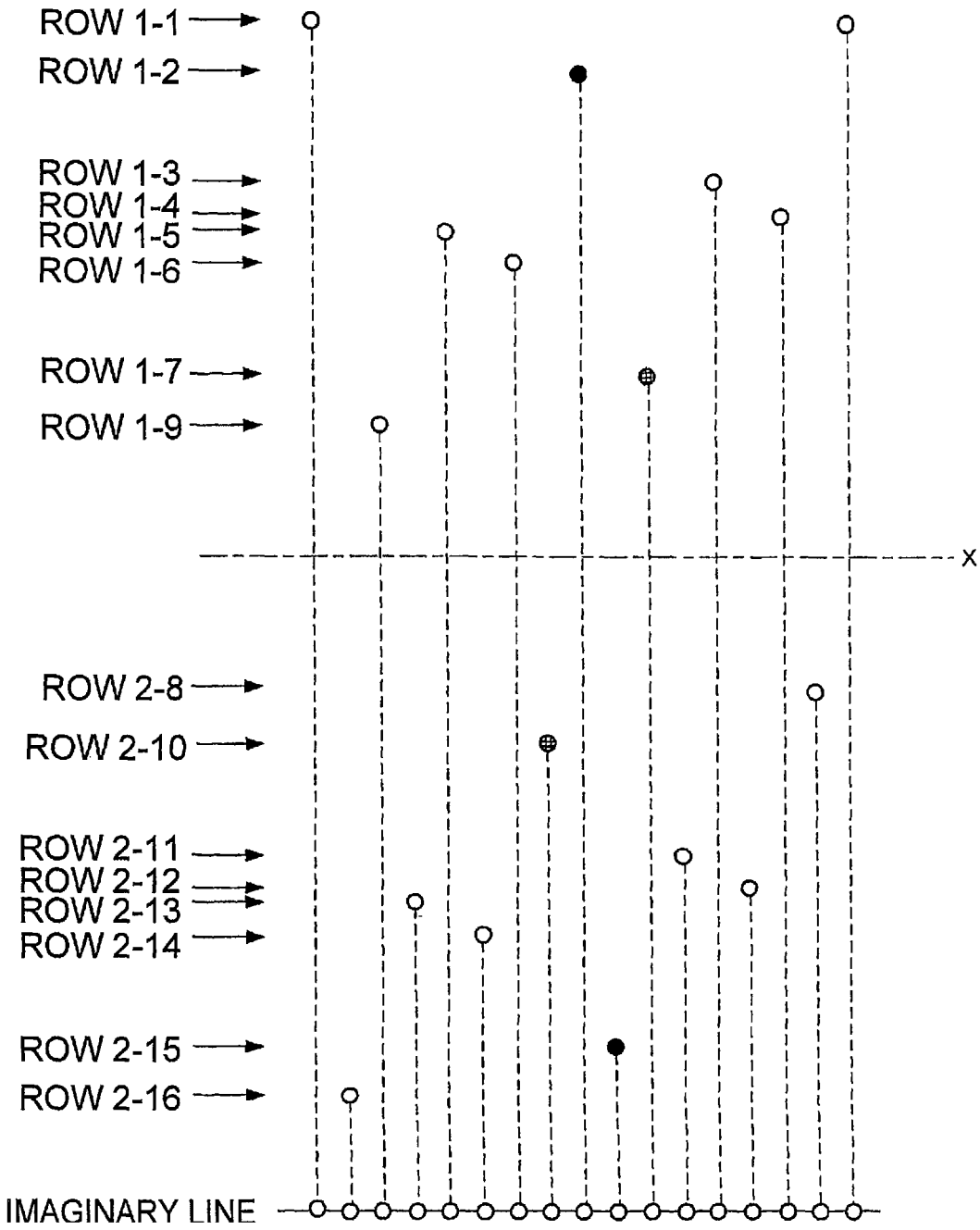
FIG. 9 is an enlarged view showing the positional relationships among ink discharge nozzles located within an elongate zone R2 shown in FIG. 7.

Referring to FIG. 9, similar to the 17 ink discharge nozzles 8 belonging to the elongate zone R1, the 17 ink discharge nozzles 8 in the elongate zone R2 are projected onto an imaginary line, and the resulting adjacent projective points are equally spaced apart from each other by a distance corresponding to 600 dpi. FIG. 9 is shown at different scales between the vertical and horizontal directions.

Figure 10:
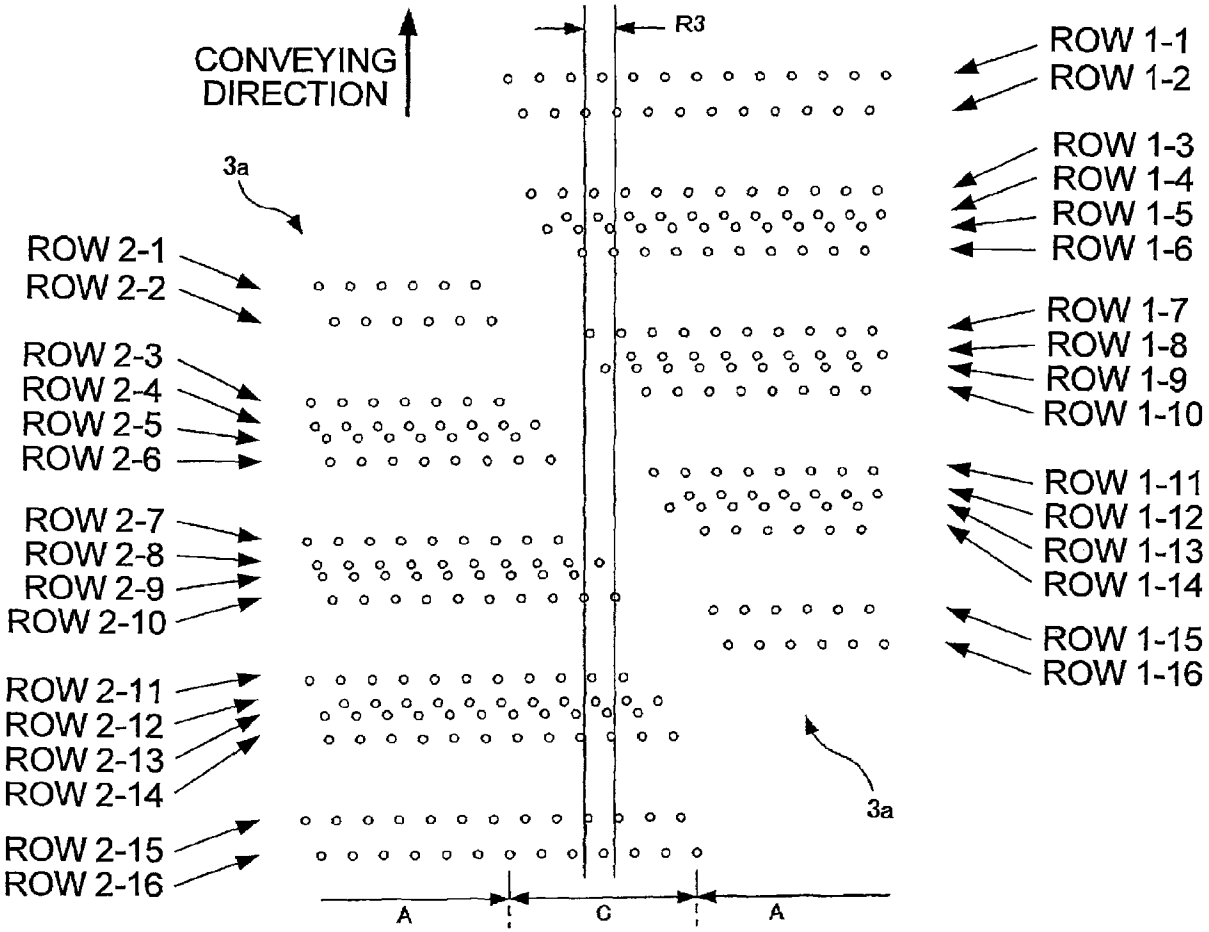
FIG. 10 is an enlarged view of area C shown in FIG. 6 and its surrounding areas.

Referring to FIG. 10, in area C, an elongate zone R3 is defined between two lines that extend in the widthwise direction and intersect with two adjacent ink discharge nozzles 8 of the plurality of ink discharge nozzles 8 belonging to the row 1-2. In addition to the two adjacent ink discharge nozzles 8 belonging to the row 1-2, the elongate zone R3 includes one ink discharge nozzle 8 from each of 15 rows, namely, one ink discharge nozzle 8 from the row 1-1 in the first discharge-nozzle region, one ink discharge nozzle 8 from each of five rows from the rows 1-3 to 1-7 in the first discharge-nozzle region, one ink discharge nozzle 8 from the row 1-9 in the first discharge-nozzle region, one ink discharge nozzle 8 from the row 2-8 in the second discharge-nozzle region, and one ink discharge nozzle 8 from each of seven rows from the rows 2-10 to 2-16 in the second discharge-nozzle region.

Figure 11:
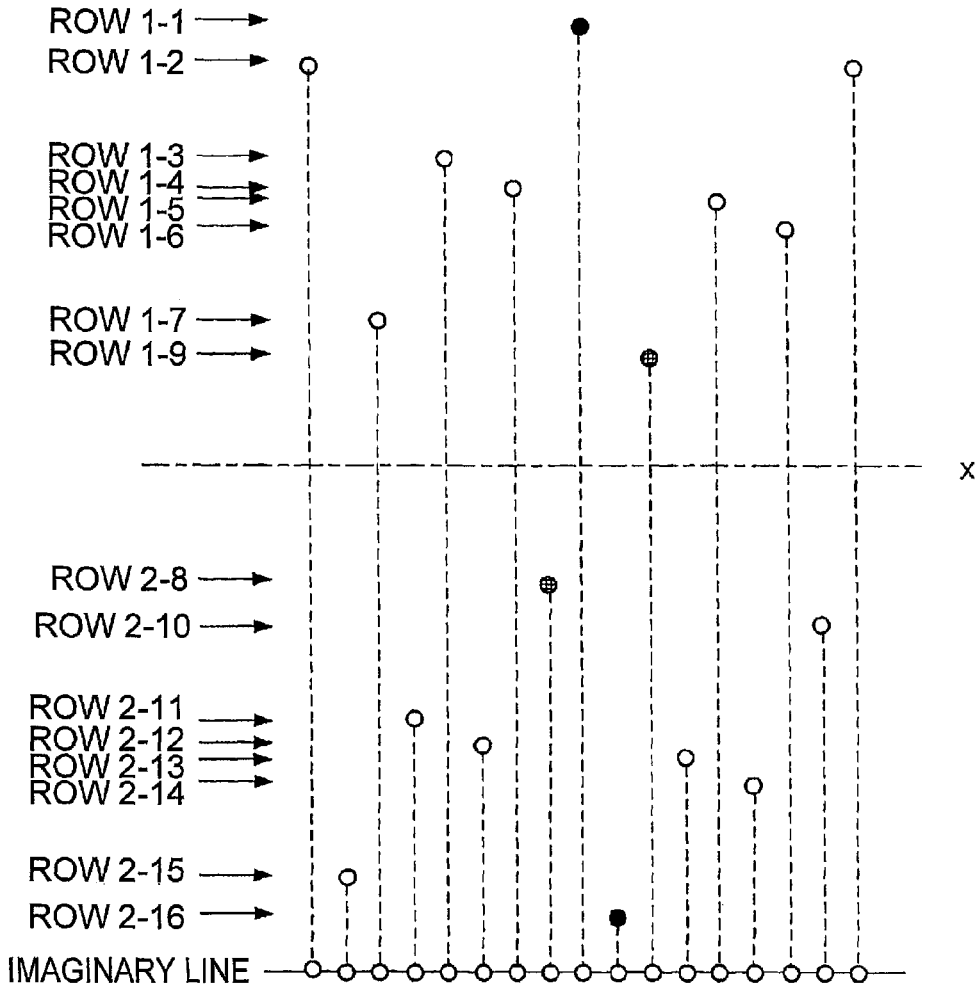
FIG. 11 is an enlarged view showing the positional relationships among ink discharge nozzles located within an elongate zone R3 shown in FIG. 10.

Referring to FIG. 11, similar to the 17 ink discharge nozzles 8 belonging to each of the elongate zones R1 and R2, the 17 ink discharge nozzles 8 in the elongate zone R3 are projected onto an imaginary line, and the resulting adjacent projective points are equally spaced apart from each other by a distance corresponding to 600 dpi. FIG. 11 is shown at different scales between the vertical and horizontal directions.

Figure 12:
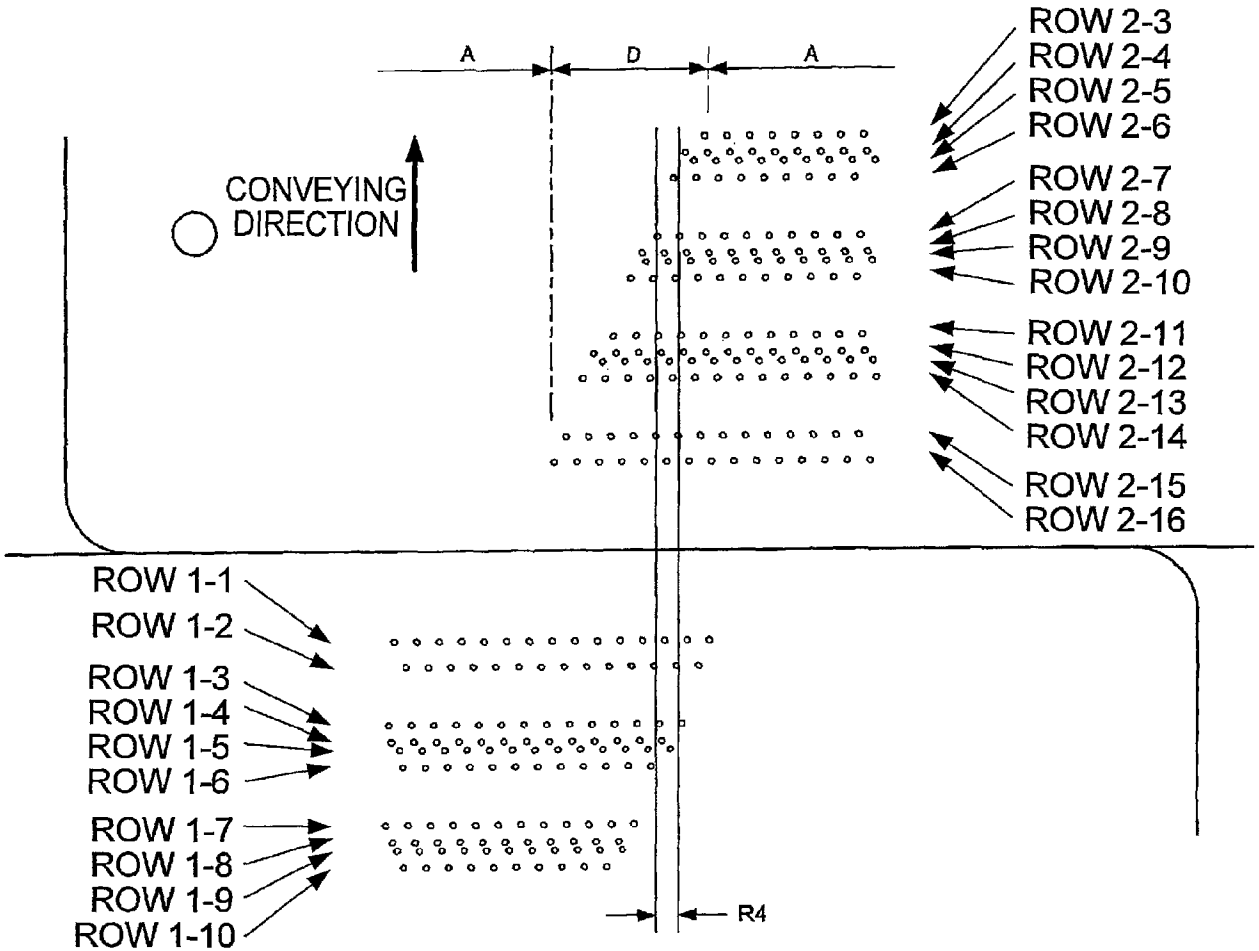
FIG. 12 is an enlarged view of area D shown in FIG. 6 and its surrounding areas.

Referring to FIG. 12, in area D, an elongate zone R4 is defined between two lines that extend in the widthwise direction of the nozzle plates 30 and intersect with two adjacent ink discharge nozzles 8 of the plurality of ink discharge nozzles 8 belonging to the row 2-7. In addition to the two adjacent ink discharge nozzles 8 belonging to the row 2-7, the elongate zone R4 includes one ink discharge nozzle 8 from each of 15 rows, namely, one ink discharge nozzle 8 from the row 2-6 in the second discharge-nozzle region of the first nozzle plate, one ink discharge nozzle 8 from each of nine rows from the rows 2-8 to 2-16 in the second discharge-nozzle region of the first nozzle plate, and one discharge nozzle 8 from each of five rows from the rows 1-1 to 1-5 in the first discharge-nozzle region of the second nozzle plate.

Figure 13:
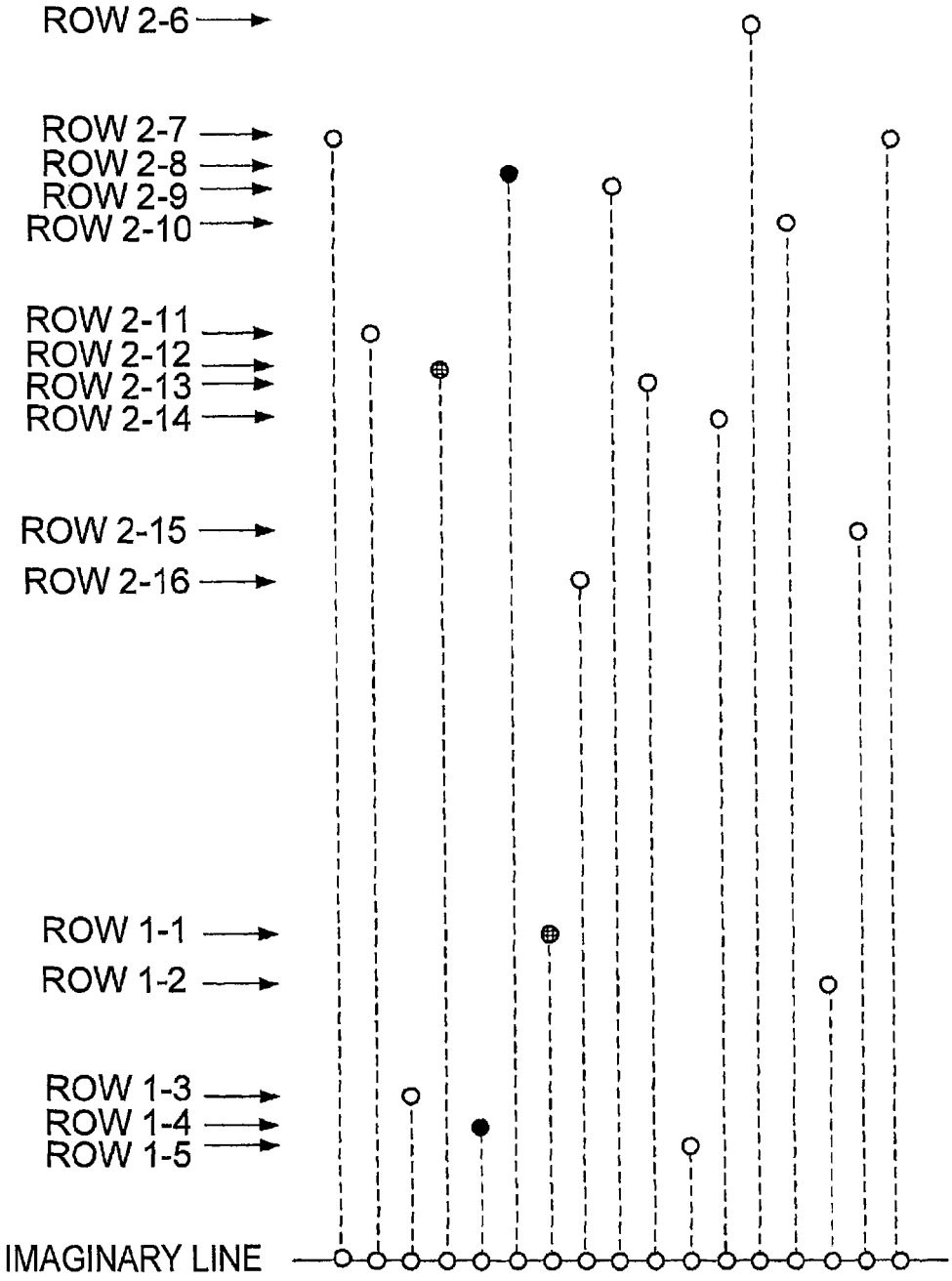
FIG. 13 is an enlarged view showing the positional relationships among ink discharge nozzles located within an elongate zone R4 shown in FIG. 10.

Referring to FIG. 13, similar to the 17 ink discharge nozzles 8 belonging to each of the elongate zones R1, R2, and R3, the 17 ink discharge nozzles 8 in the elongate zone R4 are projected onto an imaginary line, and the resulting adjacent projective points are equally spaced apart from each other by a distance corresponding to 600 dpi. FIG. 13 is shown at different scales between the vertical and horizontal directions.

The above-described inkjet heads 2 are installed in the printer 1 in a manner such that the widthwise direction of the inkjet heads 2 is aligned with the sub scanning direction which corresponds to the sheet conveying direction. However, if the inkjet heads 2 are not properly positioned or if there is deviation in the sheet conveying direction of the conveying mechanism 12, the widthwise direction of the inkjet heads 2 and the sub scanning direction becomes misaligned with each other. In that case, there may be void sections created in the formed image, thus deteriorating the image quality. The following description is directed to a method for checking for misalignment between the widthwise direction of the inkjet heads 2 installed in the printer 1 and the sub scanning direction.

First, the control device 60 controls at least two ink discharge nozzles 8 whose projective points are adjacent to each other on an imaginary line and which respectively belong to two non-adjacent rows, so that ink is discharged from these ink discharge nozzles 8 towards a sheet conveyed by the conveying mechanism 12. As a result, a test pattern consisting of at least two lines is formed. More specifically, the control device 60 activates the aforementioned test-pattern forming program stored in the hard disk drive so as to drive predetermined actuators included in the actuator unit 21 to be used for forming the test pattern. In this embodiment, a process is executed by the program for discharging ink towards a conveyed sheet from a total of four ink discharge nozzles 8 (ink discharge nozzle group), which includes two ink discharge nozzles 8 shown as black dots in FIG. 8 (referred to as a "pair of main ink discharge nozzles" or "two main ink discharge nozzles" hereinafter) and two ink discharge nozzles 8 shown as shaded dots in FIG. 8 (referred to as a "pair of subsidiary ink discharge nozzles" or "two subsidiary ink discharge nozzles" hereinafter). Consequently, a test pattern consisting of four lines is formed.

Referring back to FIG. 8, the two ink discharge nozzles 8 shown as black dots serving as a pair of main ink discharge nozzles respectively belong to the rows 1-1 and 1-16, and the projective points thereof on the imaginary line are adjacent to each other. The rows 1-1 and 1-16 are the outermost rows of the 16 rows within a single discharge-nozzle region 3*a* and are also two rows most distant from each other in the widthwise direction among the 16 rows. This implies that the distance between two lines formed as the result of ink discharged from the two main ink discharge nozzles 8 can vary relatively significantly in accordance with misalignment between the widthwise direction and the sub scanning direction.

The two ink discharge nozzles 8 shown as shaded dots serving as a pair of subsidiary ink discharge nozzles respectively belong to the rows 1-8 and 1-9, and the projective points thereof on the imaginary line are respectively adjacent to the projective points of the two main ink discharge nozzles 8. Specifically, the projective point of the ink discharge nozzle 8 belonging to the row 1-8 is adjacent to the projective point of the ink discharge nozzle 8 belonging to the row 1-1, and the projective point of the ink discharge nozzle 8 belonging to the row 1-9 is adjacent to the projective point of the ink discharge nozzle 8 belonging to the row 1-16. The rows 1-8 and 1-9 are adjacent to each other. In other words, the two ink discharge nozzles 8 serving as the pair of subsidiary ink discharge nozzles are spaced apart from each other by a relatively short distance in the widthwise direction. Consequently, a variation in the distance between two lines formed as the result of ink discharged from these two subsidiary ink discharge nozzles 8 is relatively small with respect to misalignment between the widthwise direction and the sub scanning direction.

One of the main ink discharge nozzles 8 located at one side (i.e. upper side in FIG. 8) in the widthwise direction (i.e. the ink discharge nozzle 8 belonging to the 1-1 line) and one of the subsidiary ink discharge nozzles 8 also located at the one side (i.e. upper side in FIG. 8) in the widthwise direction (i.e. the ink discharge nozzle 8 belonging to the 1-8 line) are separated from each other by a distance that is equal to the distance that separates the main ink discharge nozzle 8 located at the other side (i.e. lower side in FIG. 8) in the widthwise direction (i.e. the ink discharge nozzle 8 belonging to the 1-16 line) from the subsidiary ink discharge nozzle 8 also located at the other side (i.e. lower side in FIG. 8) in the widthwise direction (i.e. the ink discharge nozzle 8 belonging to the 1-9 line).

Figure 14C:
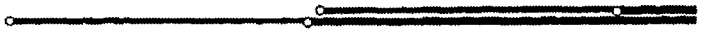
FIGS. 14A to 14C each illustrate a test pattern formed in accordance with the embodiment.
Figure 14B:
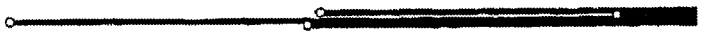
Figure 14A:
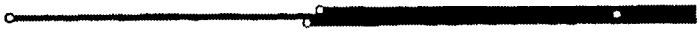

Referring to FIGS. 14A to 14C, a test pattern is formed by discharging ink from the four ink discharge nozzles 8 respectively belonging to the rows 1-1, 1-8, 1-9, and 1-16. FIG. 14A illustrates a test pattern formed in a state in which the widthwise direction of an inkjet head 2 is misaligned leftward with respect to the conveying direction at the downstream side of the inkjet head 2 in plan view. FIG. 14B illustrates a test pattern formed in a state in which the widthwise direction is in alignment with the sub scanning direction. FIG. 14C illustrates a test pattern formed in a state in which the widthwise direction of an inkjet head 2 is misaligned rightward with respect to the conveying direction at the downstream side of the inkjet head 2 in plan view.

When the widthwise direction is in alignment with the sub scanning direction as shown in FIG. 14B, the four lines formed are arranged at equal intervals. Of the four lines, the two inner lines are formed by the two ink discharge nozzles 8 serving as the pair of main ink discharge nozzles. The distance between these two inner lines can vary relatively significantly when there is misalignment between the widthwise direction and the sub scanning direction. On the other hand, the two outer lines are formed by the two ink discharge nozzles 8 serving as the pair of subsidiary ink discharge nozzles. The distance between these two outer lines is hardly variable even when there is misalignment between the widthwise direction and the sub scanning direction. Consequently, when the widthwise direction of an inkjet head 2 is misaligned leftward with respect to the conveying direction at the downstream side of the inkjet head 2 as shown in FIG. 14A, the distance between two lines formed by the pair of main ink discharge nozzles becomes shorter, whereas there is hardly any variation in the distance between two lines formed by the pair of subsidiary ink discharge nozzles. As a result, void sections are created between the two inner lines and the two outer lines at opposite sides thereof. On the other hand, when the widthwise direction of an inkjet head 2 is misaligned rightward with respect to the conveying direction at the downstream side of the inkjet head 2 as shown in FIG. 14C, the distance between two lines formed by the pair of main ink discharge nozzles becomes greater, thus creating a void section between the two inner lines.

By observing these test patterns, it can be determined whether or not there is misalignment between the widthwise direction and the sub scanning direction, and if there is, the direction of the misalignment can be determined. In other words, in the case where a test pattern as shown in FIG. 14A or 14C is obtained, the installation position of the inkjet heads 2 or the conveying direction by the conveying mechanism 12 can be corrected so as to align the widthwise direction and the sub scanning direction with each other.

Accordingly, when the printer 1 according to this embodiment performs a test-pattern forming process, the printer 1 allows ink to be discharged from the pair of main ink discharge nozzles, which are the two ink discharge nozzles 8 whose projective points are adjacent to each other on an imaginary line and respectively belonging to the outermost rows 1-1 and 1-16 of the 16 rows within a single discharge-nozzle region 3*a*. A variation in the distance between two lines formed by two ink discharge nozzles 8 with respect to the degree of misalignment between the widthwise direction of an inkjet head 2 and the sub scanning direction becomes greater as the distance between the two ink discharge nozzles 8 in the widthwise direction increases. Accordingly, since the test pattern according to this embodiment is formed using ink discharge nozzles 8 belonging to two rows that are most distant from each other in the widthwise direction, misalignment between the widthwise direction and the sub scanning direction can be detected with high accuracy.

Furthermore, when the printer 1 according to this embodiment performs a test-pattern forming process, the printer 1 also allows ink to be discharged from the pair of subsidiary ink discharge nozzles in addition of the pair of main ink discharge nozzles. Specifically, as described above, the pair of subsidiary ink discharge nozzles are two ink discharge nozzles 8 whose projective points on the imaginary line are respectively adjacent to the projective points of the two main ink discharge nozzles 8, and moreover, the distance between one subsidiary ink discharge nozzle 8 and one main ink discharge nozzle 8 that are located at the same side in the widthwise direction is equal to the distance between the other subsidiary ink discharge nozzle 8 and the other main ink discharge nozzle 8 that are located at the other side in the widthwise direction. Thus, a variation in the distance between two lines formed as the result of ink discharged from the two main ink discharge nozzles 8 can be detected readily on the basis of two lines formed as the result of ink discharged from the two subsidiary ink discharge nozzles 8. Since the test pattern is formed by discharging ink only from four ink discharge nozzles 8, i.e. the two main ink discharge nozzles 8 and the two subsidiary ink discharge nozzles 8, the amount of ink consumption can be reduced.

In the printer 1 according to this embodiment, the two rows to which the two subsidiary ink discharge nozzles 8 belong are adjacent to each other. Consequently, there is relatively small variation in the distance between two lines formed by the two subsidiary ink discharge nozzles 8 with respect to misalignment between the widthwise direction and the sub scanning direction. Based on these two lines, a variation in the distance between two lines formed by the two main ink discharge nozzles 8 can be readily detected.

Furthermore, in the printer 1 according to this embodiment, the pair of main ink discharge nozzles and the pair of subsidiary ink discharge nozzles to be used for a test-pattern forming process all belong to one of four discharge-nozzle regions 3*a* formed on a nozzle plate 30. This allows for detection of misalignment between the conveying direction of the conveying mechanism 12 and the widthwise direction of the inkjet head 2 having the discharge-nozzle region 3*a* to which the pair of main ink discharge nozzles and the pair of subsidiary ink discharge nozzles belong.

Modifications of this embodiment will be described below. The components in the printer 1 in these modifications will be given the same reference numerals as those used in the above-described embodiment, and the descriptions of these components will not be repeated.

One Modification

In this modification, ink is discharged towards a sheet conveyed by the conveying mechanism 12 by using a total of four ink discharge nozzles 8 (ink discharge nozzle group), which includes a pair of main ink discharge nozzles 8 shown as black dots in FIG. 9 and a pair of subsidiary ink discharge nozzles 8 shown as shaded dots in FIG. 9, thereby forming a test pattern consisting of four lines. Specifically, a test pattern is formed using ink discharge nozzles 8 located within the elongate zone R2 in area B (see FIG. 6).

Referring to FIG. 9, the two main ink discharge nozzles 8 shown as black dots respectively belong to the rows 1-2 and 2-15, and the projective points thereof on the imaginary line are adjacent to each other. The rows 1-2 and 2-15 are located second from the outermost rows of the 16 rows to which the ink discharge nozzles 8 located within the elongate zone R2 belong. In addition, the rows 1-2 and 2-15 are separated from each other by a relatively large distance in the widthwise direction. This implies that the distance between two lines formed as the result of ink discharged from the two main ink discharge nozzles 8 can vary relatively significantly in accordance with misalignment between the widthwise direction and the sub scanning direction.

The two subsidiary ink discharge nozzles 8 shown as shaded dots respectively belong to the rows 2-10 and 1-7, and the projective points thereof on the imaginary line are respectively adjacent to the projective points of the two main ink discharge nozzles 8. Specifically, the projective point of the ink discharge nozzle 8 belonging to the row 2-10 is adjacent to the projective point of the ink discharge nozzle 8 belonging to the row 1-2, and the projective point of the ink discharge nozzle 8 belonging to the row 1-7 is adjacent to the projective point of the ink discharge nozzle 8 belonging to the row 2-15. Because the rows 2-10 and 1-7 are located between the rows 1-2 and 2-15 to which the main ink discharge nozzles belong, a variation in the distance between two lines formed by the subsidiary ink discharge nozzles occurring due to misalignment between the widthwise direction and the sub scanning direction is smaller as compared to a variation in the distance between two lines formed by the main ink discharge nozzles.

Furthermore, in this modification, the two main ink discharge nozzles 8 respectively belong to a first discharge-nozzle region and a second discharge-nozzle region, which are two adjacent discharge-nozzle regions 3*a* on a single nozzle plate 30. Likewise, the two subsidiary ink discharge nozzles 8 also belong to the first discharge-nozzle region and the second discharge-nozzle region, respectively.

Moreover, similar to the above-described embodiment, one of the main ink discharge nozzles 8 located at one side (i.e. upper side in FIG. 9) in the widthwise direction and one of the subsidiary ink discharge nozzles 8 also located at the one side (i.e. upper side in FIG. 9) in the widthwise direction are separated from each other by a distance that is equal to the distance that separates the main ink discharge nozzle 8 located at the other side (i.e. lower side in FIG. 9) in the widthwise direction from the subsidiary ink discharge nozzle 8 also located at the other side (i.e. lower side in FIG. 9) in the widthwise direction. In addition, the center position between the two rows to which the two main ink discharge nozzles 8 belong, i.e. the rows 1-2 and 2-15, coincides with the center position of the nozzle plate 30 in the widthwise direction (i.e. positioned indicated by a dot-dash line X in FIG. 9).

Furthermore, one of the two main ink discharge nozzles 8 that is located at one side (i.e. upper side in FIG. 9) in the widthwise direction (i.e. the ink discharge nozzle 8 belonging to the row 1-2) and one of the two subsidiary ink discharge nozzles 8 that is located at the other side (i.e. lower side in FIG. 9) in the widthwise direction (i.e. the ink discharge nozzle 8 belonging to the row 2-10) have projective points positioned adjacent to each other on the imaginary line. Likewise, the projective point of the ink discharge nozzle 8 belonging to the row 2-15 and the projective point of the ink discharge nozzle 8 belonging to the row 1-7 are also positioned adjacent to each other on the imaginary line.

Figures 15A, 15B, 15C:
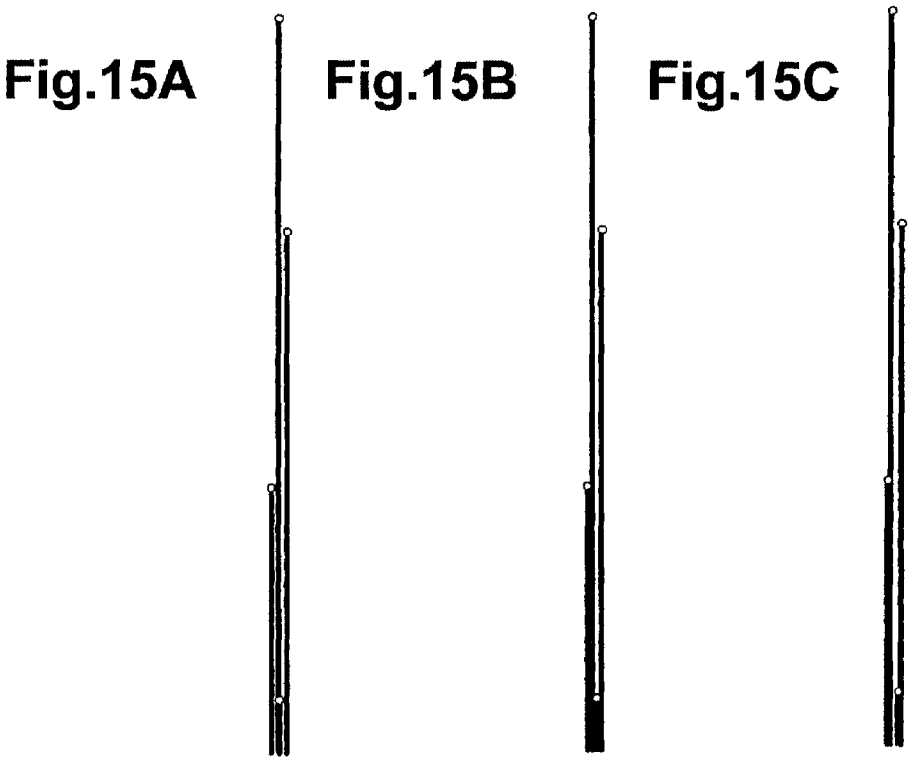
FIGS. 15A to 15C each illustrate a test pattern formed in accordance with one modification of the embodiment.

FIGS. 15A to 15C each illustrate a test pattern formed by discharging ink from the four ink discharge nozzles 8 respectively belonging to the rows 1-2, 1-7, 2-10, and 2-15. FIG. 15A illustrates a test pattern formed in a state in which the widthwise direction of an inkjet head 2 is misaligned leftward with respect to the conveying direction at the downstream side of the inkjet head 2 in plan view. FIG. 15B illustrates a test pattern formed in a state in which the widthwise direction is in alignment with the sub scanning direction. FIG. 15C illustrates a test pattern formed in a state in which the widthwise direction of an inkjet head 2 is misaligned rightward with respect to the conveying direction at the downstream side of the inkjet head 2 in plan view.

The test patterns obtained in accordance with this modification as shown in FIGS. 15A to 15C are similar to the test patterns obtained in the above-described embodiment. Specifically, when the widthwise direction is misaligned leftward with respect to the conveying direction at the downstream side of the inkjet head 2 as shown in FIG. 15A, the distance between two lines formed by the pair of main ink discharge nozzles becomes shorter, thus creating void sections between the two inner lines and the two outer lines at opposite sides thereof. When the widthwise direction is in alignment with the sub scanning direction as shown in FIG. 15B, the four lines formed are arranged at equal intervals. When the widthwise direction is misaligned rightward with respect to the conveying direction at the downstream side of the inkjet head 2 as shown in FIG. 15C, the distance between two lines formed by the pair of main ink discharge nozzles becomes greater, thus creating a void section between the two inner lines.

Accordingly, like the above-described embodiment, this modification allows for highly accurate detection of misalignment between the widthwise direction and the sub scanning direction.

As mentioned above, in this modification, the center position between the two rows to which the two main ink discharge nozzles 8 belong coincides with the center position of the nozzle plate 30 in the widthwise direction. Supposing that the misalignment between the widthwise direction and the sub scanning direction is centered on the center position X of the nozzle plate 30 in the widthwise direction, the amount of misalignment would be the same for the two lines formed as the result of ink discharged from the two main ink discharge nozzles 8. The same applies to the two lines formed as the result of ink discharged from the two subsidiary ink discharge nozzles 8. Accordingly, a variation in the distance between two lines formed by the two main ink discharge nozzles 8 can be detected readily.

Furthermore, as described above, one of the two main ink discharge nozzles 8 that is located at one side in the widthwise direction and one of the two subsidiary ink discharge nozzles 8 that is located at the other side in the widthwise direction have projective points positioned adjacent to each other on the imaginary line. Therefore, the distance between two lines formed by the two main ink discharge nozzles 8 and the distance between two lines formed by the two subsidiary ink discharge nozzles 8 have a relationship such that when one of the distances increases due to misalignment between the widthwise direction and the sub scanning direction, the other distance decreases. Accordingly, a variation in the distance between two lines formed by the two main ink discharge nozzles 8 can be detected even more readily.

Another Modification

In this modification, the ink discharge group includes a total of four ink discharge nozzles 8, namely, a pair of main ink discharge nozzles 8 shown as black dots in FIG. 11 and a pair of subsidiary ink discharge nozzles 8 shown as shaded dots in FIG. 11. These four ink discharge nozzles 8 are used to discharge ink towards a sheet conveyed by the conveying mechanism 12, thereby forming a test pattern consisting of four lines. Specifically, a test pattern is formed using ink discharge nozzles 8 located within the elongate zone R3 in area C (see FIG. 6).

Referring to FIG. 11, the two main ink discharge nozzles 8 shown as black dots respectively belong to the rows 1-1 and 2-16, and the projective points thereof on the imaginary line are adjacent to each other. Of all the pairs of ink discharge nozzles 8 in the elongate zone R3 whose projective points are adjacent to each other on the imaginary line, the two main ink discharge nozzles 8 selected are those that belong to two rows that are most distant from each other in the widthwise direction. This implies that the distance between two lines formed as the result of ink discharged from these two main ink discharge nozzles 8 can vary relatively significantly in accordance with misalignment between the widthwise direction and the sub scanning direction.

The two subsidiary ink discharge nozzles 8 shown as shaded dots respectively belong to the rows 1-9 and 2-8, and the projective points thereof on the imaginary line are respectively adjacent to the projective points of the two main ink discharge nozzles 8. Specifically, the projective point of the ink discharge nozzle 8 belonging to the row 1-1 is adjacent to the projective point of the ink discharge nozzle 8 belonging to the row 2-8, and the projective point of the ink discharge nozzle 8 belonging to the row 2-16 is adjacent to the projective point of the ink discharge nozzle 8 belonging to the row 1-9.

Moreover, similar to the above-described embodiment, one of the main ink discharge nozzles 8 located at one side (i.e. upper side in FIG. 11) in the widthwise direction and one of the subsidiary ink discharge nozzles 8 also located at the one side (i.e. upper side in FIG. 11) in the widthwise direction are separated from each other by a distance that is equal to the distance that separates the main ink discharge nozzle 8 located at the other side (i.e. lower side in FIG. 11) in the widthwise direction from the subsidiary ink discharge nozzle 8 also located at the other side (i.e. lower side in FIG. 11) in the widthwise direction. In addition, the center position between the two rows to which the two main ink discharge nozzles 8 belong coincides with the center position of the nozzle plate 30 in the widthwise direction (i.e. position indicated by a dot-dash line X in FIG. 11).

Furthermore, one of the two main ink discharge nozzles 8 that is located at one side in the widthwise direction and one of the two subsidiary ink discharge nozzles 8 that is located at the other side in the widthwise direction have projective points positioned adjacent to each other on the imaginary line.

Figure 16A:
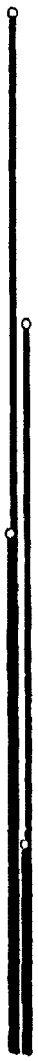
FIGS. 16A to 16C each illustrate a test pattern formed in accordance with another modification of the embodiment.
Figure 16B:
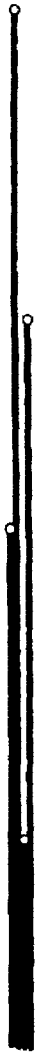
Figure 16C:
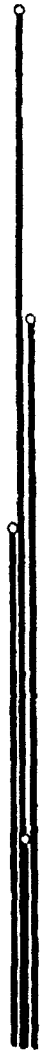

FIGS. 16A to 16C each illustrate a test pattern formed by discharging ink from the four ink discharge nozzles 8 respectively belonging to the rows 1-1, 1-9, 2-8, and 2-16. FIG. 16A illustrates a test pattern formed in a state in which the widthwise direction of an inkjet head 2 is misaligned leftward with respect to the conveying direction at the downstream side of the inkjet head 2 in plan view. FIG. 16B illustrates a test pattern formed in a state in which the widthwise direction is in alignment with the sub scanning direction. FIG. 16C illustrates a test pattern formed in a state in which the widthwise direction of an inkjet head 2 is misaligned rightward with respect to the conveying direction at the downstream side of the inkjet head 2 in plan view.

Referring to FIGS. 16A to 16C, the test patterns obtained in accordance with this modification are such that when the widthwise direction is misaligned leftward with respect to the conveying direction at the downstream side of the inkjet head 2 as shown in FIG. 16A, the distance between two lines formed by the pair of main ink discharge nozzles becomes greater, thus creating a void section between the two inner lines. When the widthwise direction is in alignment with the sub scanning direction as shown in FIG. 16B, the four lines formed are arranged at equal intervals. When the widthwise direction is misaligned rightward with respect to the conveying direction at the downstream side of the inkjet head 2 as shown in FIG. 16C, the distance between two lines formed by the pair of main ink discharge nozzles becomes shorter, thus creating void sections between the two inner lines and the two outer lines at opposite sides thereof.

Accordingly, like the above-described embodiment, this modification allows for highly accurate detection of misalignment between the widthwise direction and the sub scanning direction.

Another Modification

In this modification, the ink discharge group includes a total of four ink discharge nozzles 8, namely, a pair of main ink discharge nozzles 8 shown as black dots in FIG. 13 and a pair of subsidiary ink discharge nozzles 8 shown as shaded dots in FIG. 13. These four ink discharge nozzles 8 are used to discharge ink towards a sheet conveyed by the conveying mechanism 12, thereby forming a test pattern consisting of four lines. Specifically, a test pattern is formed using ink discharge nozzles 8 located within the elongate zone R4 in area D (see FIG. 6).

Referring to FIG. 13, the two main ink discharge nozzles 8 shown as black dots respectively belong to the rows 2-8 and 1-4, and the projective points thereof on the imaginary line are adjacent to each other. Of all the pairs of ink discharge nozzles 8 in the elongate zone R4 whose projective points are adjacent to each other on the imaginary line, the two main ink discharge nozzles 8 selected are those that belong to two rows that are most distant from each other in the widthwise direction. This implies that the distance between two lines formed as the result of ink discharged from these two main ink discharge nozzles 8 varies by the greatest amount, as compared to the variations in the description above, in accordance with misalignment between the widthwise direction and the sub scanning direction.

The two subsidiary ink discharge nozzles 8 shown as shaded dots respectively belong to the rows 2-12 and 1-1, and the projective points thereof on the imaginary line are respectively adjacent to the projective points of the two main ink discharge nozzles 8. Specifically, the projective point of the ink discharge nozzle 8 belonging to the row 2-12 is adjacent to the projective point of the ink discharge nozzle 8 belonging to the row 1-4, and the projective point of the ink discharge nozzle 8 belonging to the row 1-1 is adjacent to the projective point of the ink discharge nozzle 8 belonging to the row 2-8.

Furthermore, in this modification, the two main ink discharge nozzles 8 respectively belong to a second discharge-nozzle region on the first nozzle plate and a first discharge-nozzle region on the second nozzle plate. Likewise, the two subsidiary ink discharge nozzles 8 also belong to the second discharge-nozzle region on the first nozzle plate and the first discharge-nozzle region on the second nozzle plate, respectively.

Figure 17A:
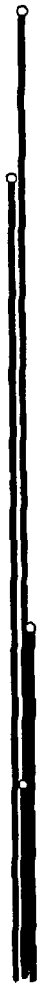
FIGS. 17A to 17C each illustrate a test pattern formed in accordance with another modification of the embodiment.
Figure 17B:
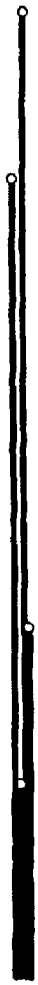
Figure 17C:
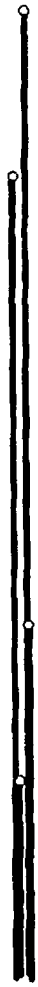

FIGS. 17A to 17C each illustrate a test pattern formed by discharging ink from the four ink discharge nozzles 8 respectively belonging to the rows 2-8, 2-12, 1-1, and 1-4. FIG. 17A illustrates a test pattern formed in a state in which the widthwise direction of two adjacent inkjet heads 2 is misaligned leftward with respect to the conveying direction at the downstream side of the inkjet heads 2 in plan view. FIG. 17B illustrates a test pattern formed in a state in which the widthwise direction is in alignment with the sub scanning direction. FIG. 17C illustrates a test pattern formed in a state in which the widthwise direction of two adjacent inkjet heads 2 is misaligned rightward with respect to the conveying direction at the downstream side of the inkjet heads 2 in plan view.

Referring to FIGS. 17A to 17C, similar to the test patterns obtained in the above-described embodiment, the test patterns obtained in accordance with this modification are such that when the widthwise direction is misaligned leftward with respect to the conveying direction at the downstream side as shown in FIG. 17A, the distance between two lines formed by the pair of main ink discharge nozzles becomes shorter, thus creating void sections between the two inner lines and the two outer lines at opposite sides thereof. When the widthwise direction is in alignment with the sub scanning direction as shown in FIG. 17B, the four lines formed are arranged at equal intervals. When the widthwise direction is misaligned rightward with respect to the conveying direction at the downstream side as shown in FIG. 17C, the distance between two lines formed by the pair of main ink discharge nozzles becomes greater, thus creating a void section between the two inner lines.

Accordingly, like the above-described embodiment, this modification allows for highly accurate detection of misalignment between the widthwise direction and the sub scanning direction.

In this modification, the rows to which the two main ink discharge nozzles 8 belong can be separated from each other by a greater distance in the widthwise direction as compared to the case where a test pattern is formed using only the ink discharge nozzles 8 in the nozzle plate of a single inkjet head 2. Accordingly, misalignment between the widthwise direction and the sub scanning direction can be detected with even higher accuracy.

In addition, this modification allows for detection of positional misalignment between two inkjet heads 2 by comparing the test pattern corresponding to area D with the test patterns corresponding to areas A to C. For example, when there are no void sections in the test patterns corresponding to areas A to C while there is a void section in the test pattern corresponding to area D, it can be determined that there is positional misalignment between the combined inkjet heads 2.

Another Embodiment

Figure 18:
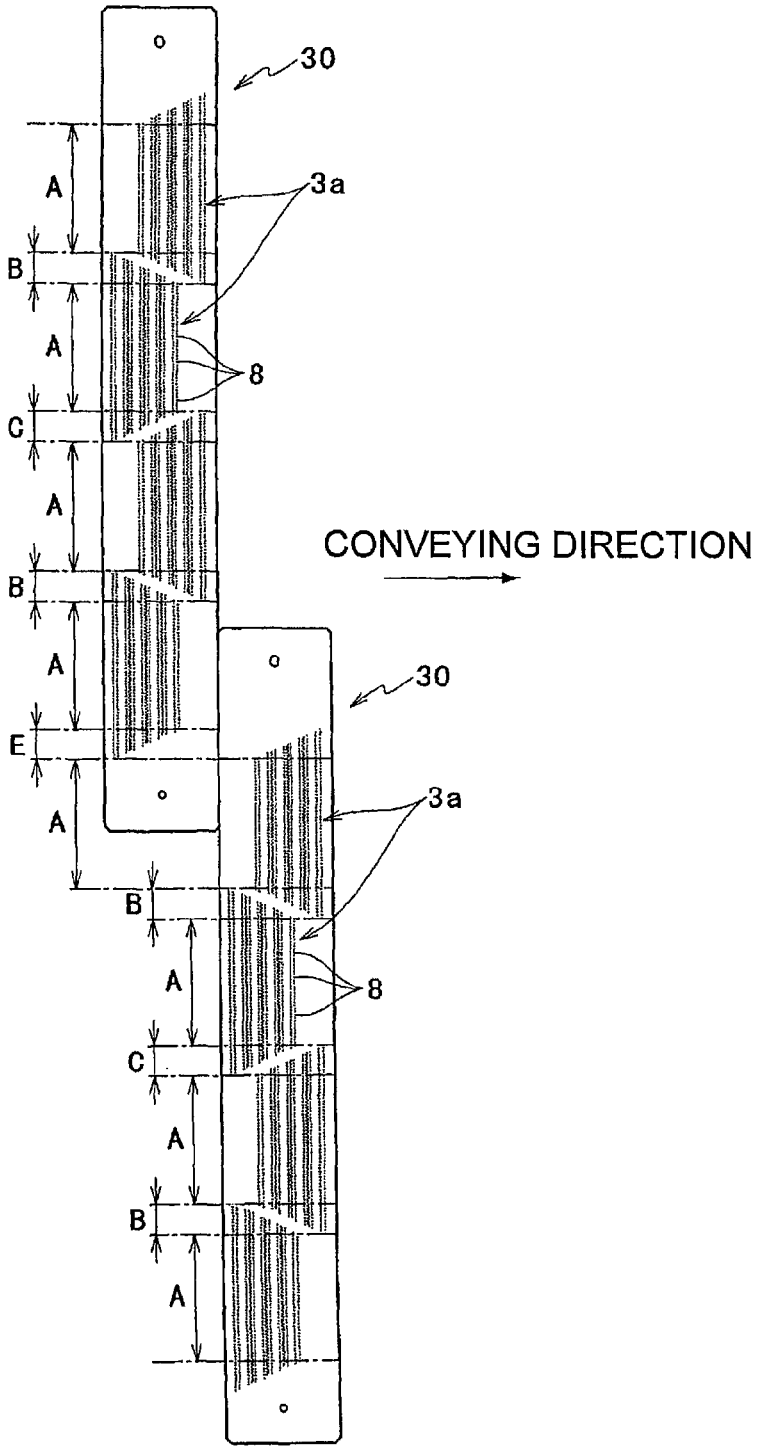
FIG. 18 is a bottom view of nozzle plates included in an adjacent pair of inkjet heads corresponding to the same color ink according to another embodiment.

Another embodiment will be described below with reference to FIG. 18. A printer according to this embodiment mainly differs from the printer 1 according to the above-described embodiments in the following points. In the above-described embodiments, the first and second nozzle plates of an adjacent pair of inkjet heads 2 corresponding to the same color ink are arranged such that the lower bases of the opposing discharge-nozzle regions 3*a* are disposed in a back-to-back fashion, as shown in FIG. 6. In contrast, in this embodiment, the upper bases of the opposing discharge-nozzle regions 3*a* are disposed in a back-to-back fashion, as shown in FIG. 18. The remaining components and configurations in the printer according to this embodiment are the same as those in the printer 1 according to the above-described embodiment, and therefore, the same reference numerals as in the above-described embodiment are used, and the descriptions of these components and configurations will not be repeated.

Referring to FIG. 18, the face of each of the first and second nozzle plates is divided into a plurality of areas arranged in the lengthwise direction. Each nozzle plate 30 can be divided into three kinds of areas, namely, areas A to C, as in the above-described embodiment. In addition, area E covers both first and second nozzle plates and includes ink discharge nozzles 8 of the two discharge-nozzle regions 3*a* respectively of the first and second nozzle plates that partially overlap each other with respect to the widthwise direction.

Figure 19:
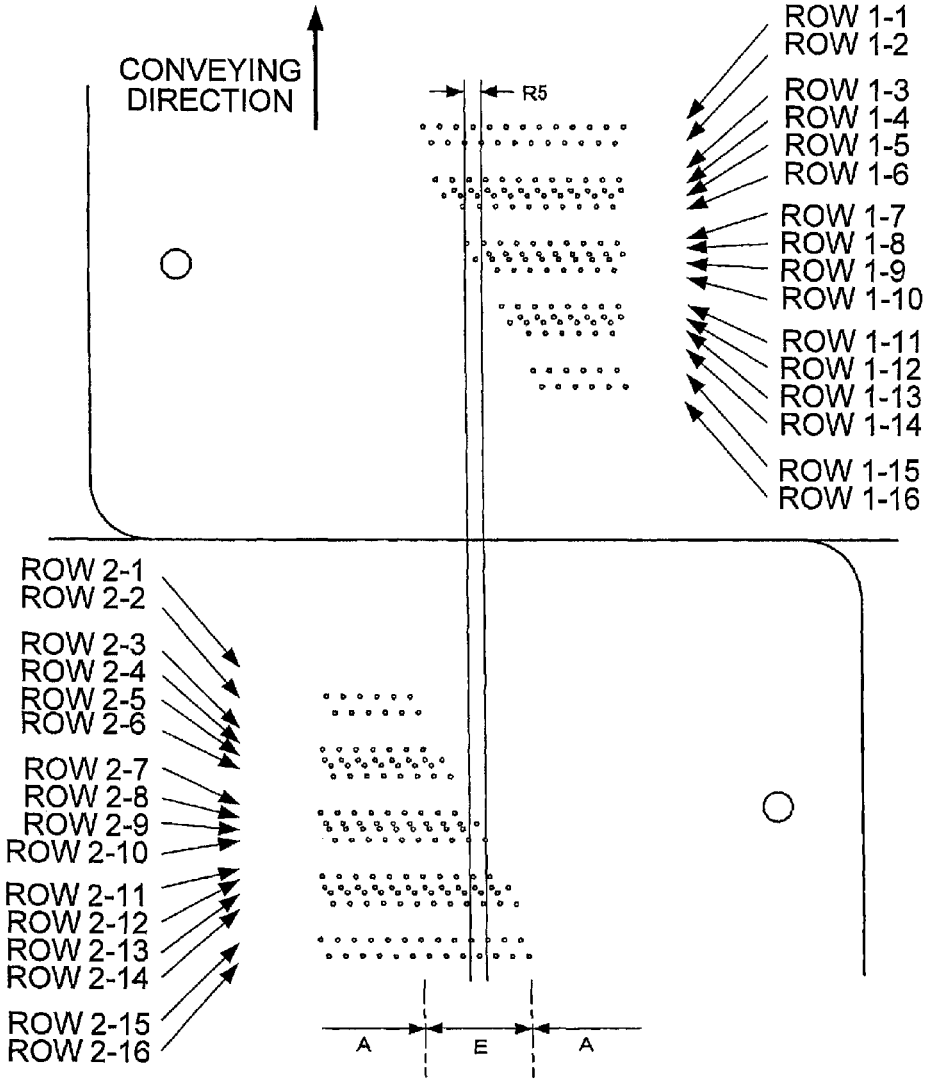
FIG. 19 is an enlarged view of area E shown in FIG. 18.

Referring to FIG. 19, an elongate zone R5 is defined between two lines that extend in the widthwise direction and intersect with two adjacent ink discharge nozzles 8 of the plurality of ink discharge nozzles 8 belonging to the row 1-2 in area E. In addition to the two adjacent ink discharge nozzles 8 belonging to the row 1-2, the elongate zone R5 includes one ink discharge nozzle 8 from each of the remaining 15 rows, namely, one ink discharge nozzle 8 from the row 1-1 in the first discharge-nozzle region, one ink discharge nozzle 8 from each of five rows from the rows 1-3 to 1-7 in the first discharge-nozzle region, one ink discharge nozzle 8 from the row 1-9 in the first discharge-nozzle region, one ink discharge nozzle 8 from the row 2-8 in the second discharge-nozzle region, and one ink discharge nozzle from each of seven rows from the rows 2-10 to 2-16 in the second discharge-nozzle region. Similar to the 17 ink discharge nozzles 8 belonging to each of the elongate zones R1, R2, and R3 in the above-described embodiment, the 17 ink discharge nozzles 8 located within the elongate zone R5 are projected onto an imaginary line, and the resulting adjacent projective points are equally spaced apart from each other by a distance corresponding to 600 dpi.

When performing a test-pattern forming process using ink discharge nozzles 8 located within the elongate zone R5 provided in area E, ink is discharged towards a sheet conveyed by the conveying mechanism 12 by using a total of four ink discharge nozzles 8 (ink discharge nozzle group), which includes the two main ink discharge nozzles 8 respectively belonging to the rows 1-1 and 2-16 and the two subsidiary ink discharge nozzles 8 respectively belonging to the rows 1-9 and 2-8. Regarding the two main ink discharge nozzles 8, the projective points thereof on the imaginary line are adjacent to each other. Regarding the two subsidiary ink discharge nozzles 8, the projective points thereof on the imaginary line are respectively adjacent to the projective points of the two main ink discharge nozzles 8.

For the purpose of achieving detectability with even higher accuracy for misalignment between the widthwise direction and the sub scanning direction, the two main ink discharge nozzles 8 selected are those that respectively belong to two rows that are most distant from each other, as in the above-described embodiment. One of the main ink discharge nozzles 8 belongs to the first discharge-nozzle region in the first nozzle plate (i.e. the upper plate in FIG. 19) while the other main ink discharge nozzle belongs to the second discharge-nozzle region in the second nozzle plate (i.e. the lower plate in FIG. 19). The two subsidiary ink discharge nozzles 8 have the same arrangement relationship.

Regarding a test pattern consisting of four lines formed as the result of ink discharged from the aforementioned four ink discharge nozzles 8, the test pattern can have void sections between the two inner lines and the two outer lines at opposite sides thereof or a void section between the two inner lines if the widthwise direction and the sub scanning direction are misaligned with each other, as in the above-described embodiment.

Accordingly, like the above-described embodiment, this embodiment allows for highly accurate detection of misalignment between the widthwise direction and the sub scanning direction.

In addition, this embodiment allows for detection of positional misalignment between two inkjet heads 2 by comparing the test pattern corresponding to area E with the test patterns corresponding to areas A to C. For example, when there are no void sections in the test patterns corresponding to areas A to C while there is a void section in the test pattern corresponding to area E, it can be determined that there is positional misalignment between the combined inkjet heads 2.

Although embodiments have been described in detail herein, the scope of this patent is not limited thereto. It will be appreciated by those of ordinary skill in the relevant art that various modifications may be made without departing from the scope of the invention. Accordingly, the embodiments disclosed herein are exemplary, and are not limiting. It is to be understood that the scope of the invention is to be determined by the claims which follow.

For example, the ink discharge nozzles 8 to be used for forming a test pattern described in the above-described embodiments are only examples, and other alternative ink discharge nozzles 8 may be used. In detail, in area C, for example, the ink discharge nozzles 8 belonging to the rows 1-1, 1-9, 2-8, and 2-16 may be replaced with the ink discharge nozzles 8 belonging to the rows 1-2, 1-7, 2-10, and 2-15.

Furthermore, although a total of four ink discharge nozzles 8, namely, two main ink discharge nozzles 8 and two subsidiary ink discharge nozzles 8, are used for discharging ink to perform a test-pattern forming process in the above-described embodiments, the test-pattern forming process may alternatively be performed by using only the main ink discharge nozzles or by using four or more ink discharge nozzles 8.

Furthermore, of all the pairs of ink discharge nozzles 8 whose projective points are adjacent to each other on the imaginary line, the two ink discharge nozzles 8 serving as the pair of main ink discharge nozzles in the above-described embodiments are those that belong to two rows that are most distant from each other in the widthwise direction. However, the two rows to which the two main ink discharge nozzles 8 respectively belong are not limited to the above-mentioned rows and may alternatively be two arbitrary rows not adjacent to each other in the widthwise direction.

Although the center position of an inkjet head 2 in the widthwise direction coincides with the center position between two rows to which the two main ink discharge nozzles 8 respectively belong in the modifications of one embodiment, the two center positions do not necessarily need to coincide with each other.

Although the two rows to which the two subsidiary ink discharge nozzles 8 belong are adjacent to each other in one embodiment, these two rows do not necessarily need to be adjacent to each other.

As described above, in the above-described embodiments, one of the two main ink discharge nozzles 8 that is located at one side in the widthwise direction and one of the two subsidiary ink discharge nozzles 8 that is located at the other side in the widthwise direction have projective points positioned adjacent to each other on the imaginary line. However, the ink discharge nozzles 8 constituting the pair of main ink discharge nozzles and the pair of subsidiary ink discharge nozzles do not necessarily need to have the above-described relationship.

In the above-described embodiments, the discharge-nozzle regions 3*a* have a trapezoidal shape. Alternatively, the discharge-nozzle regions 3*a* may have the shape of, for example, a parallelogram, rhombus, or triangle.

What is claimed is:

1. A method of forming a test pattern in a printer, wherein the printer comprises at least one liquid discharge head comprising a nozzle plate, and the nozzle plate has a plurality of nozzles formed therethrough, wherein the plurality of nozzles are configured to discharge a liquid and are arranged in a plurality of rows which are parallel to each other and extend in a particular direction perpendicular to a conveying direction of a medium, the plurality of nozzles are arranged in a plurality of discharge-nozzle areas arranged in the particular direction, such that the plurality of discharge-nozzle areas cover an entire conveying area of the medium in the particular direction, the method comprising the steps of:

selecting only a first nozzle of the plurality of nozzles from a first row of the plurality of rows;

selecting only a second nozzle of the plurality of nozzles from a second row of the plurality of rows;

discharging the liquid from the first nozzle onto the medium to form a first line comprising a plurality of liquid droplets and extending in the conveying direction and from the second nozzle onto the medium to form a second line comprising a plurality of liquid droplets and extending in the conveying direction immediately adjacent to the first line, wherein a third row of the plurality of rows is positioned between the first row and the second row in the conveying direction, wherein the nozzles arranged in each of the plurality of rows extending in the particular direction are spaced at a constant interval;

determining whether a position of the at least one discharge head corresponds to a desired predetermined position based on a position of the liquid discharged from the first nozzle onto the medium and a position of the liquid discharged from the second nozzle onto the medium, wherein the first row is positioned furthest from the second row among the plurality of rows in the conveying direction;

selecting a third nozzle of the plurality of nozzles from the third row immediately adjacent to the first nozzle in the particular direction;

selecting a fourth nozzle of the plurality of nozzles from a fourth row of the plurality of rows immediately adjacent to the second nozzle in the particular direction; and discharging the liquid from the third nozzle and from the fourth nozzle onto the medium, wherein a particular line intersects at least a portion of the first nozzle, at least a portion of the second nozzle, at least a portion of the third nozzle, and at least a portion of the fourth nozzle, and the fourth row is positioned between the first row and the second row.

2. The method of claim 1, wherein the printer further comprises a conveying mechanism configured to convey the medium toward the at least one discharge head, and at least one portion of the conveying mechanism opposes the at least one discharge head, wherein the method further comprises the step of determining whether a position of the at least one portion of the conveying mechanism corresponds to a desired particular position based on a position of the liquid discharged from the first nozzle onto the medium and a position of the liquid discharged from the second nozzle onto the medium.

3. The method of claim 1, wherein the printer further comprises a conveying mechanism configured to convey the medium toward the at least one discharge head, and at least one portion of the conveying mechanism opposes the at least one discharge head, wherein the method further comprises the step of determining whether the at least one discharge head is aligned with respect to the at least one portion of the conveying mechanism based on a position of the liquid discharged from the first nozzle onto the medium and a position of the liquid discharged from the second nozzle onto the medium.

4. The method of claim 1, wherein a distance between the first nozzle and the third nozzle is substantially equal to a distance between the second nozzle and the fourth nozzle.

5. The method of claim 1, wherein a distance between a center of the at least one discharge head and the first row in a further direction which is perpendicular to the particular direction is the same as a distance between the center of the at least one discharge head and the second row in the further direction.

6. The method of claim 1, wherein the third row is adjacent to the fourth row.

7. The method of claim 1, wherein the nozzle plate comprises:

a first trapezoidal-shaped nozzle region comprising a first portion of the plurality of nozzles; and a second trapezoidal-shaped nozzle region comprising a second portion of the plurality of nozzles, wherein each of the first trapezoidal-shaped nozzle region and the second trapezoidal-shaped nozzle region has an upper side, a lower side which is parallel to the upper side in the particular direction, a first oblique side, and a second oblique side, wherein the second oblique side of the first trapezoidal-shaped nozzle region is adjacent to the first oblique side of the second trapezoidal-shaped nozzle region and is aligned with the first oblique side of the second trapezoidal-shaped nozzle region in a direction which is perpendicular to the particular direction, wherein the first portion of the plurality of nozzles comprises the first nozzle and the second nozzle.

8. The method of claim 1, wherein the nozzle plate comprises:

a first trapezoidal-shaped nozzle region comprising a first portion of the plurality of nozzles; and a second trapezoidal-shaped nozzle region comprising a second portion of the plurality of nozzles, wherein each of the first trapezoidal-shaped nozzle region and the second trapezoidal-shaped nozzle region has an upper side, a lower side which is parallel to the upper side in the particular direction, a first oblique side, and a second oblique side, wherein the second oblique side of the first trapezoidal-shaped nozzle region is adjacent to the first oblique side of the second trapezoidal-shaped nozzle region and is aligned with the first oblique side of the second trapezoidal-shaped nozzle region in a direction which is perpendicular to the particular direction, wherein the first portion of the plurality of nozzles comprises the first nozzle, and the second portion of the plurality of nozzles comprises the second nozzle.

9. The method of claim 1, wherein the at least one liquid discharge head comprises a first liquid discharge head and a second liquid discharge head, and the nozzle plate comprises:

a first trapezoidal-shaped nozzle region comprising a first portion of the plurality of nozzles; and a second trapezoidal-shaped nozzle region comprising a second portion of the plurality of nozzles, wherein each of the first trapezoidal-shaped nozzle region and the second trapezoidal-shaped nozzle region has an upper side, a lower side which is parallel to the upper side in the particular direction, a first oblique side, and a second oblique side, wherein the second oblique side of the first trapezoidal-shaped nozzle region is adjacent to the first oblique side of the second trapezoidal-shaped nozzle region and is aligned with the first oblique side of the second trapezoidal-shaped nozzle region in a direction which is perpendicular to the particular direction, wherein the first trapezoidal-shaped nozzle region and the second trapezoidal-shaped nozzle region of each nozzle plate are aligned in the direction which is perpendicular to the particular direction.

10. A non-transitory computer readable medium bearing instructions for forming a test pattern in a printer which comprises at least one liquid discharge head comprising a nozzle plate, and the nozzle plate has a plurality of nozzles formed therethrough, wherein the plurality of nozzles are configured to discharge a liquid and are arranged in a plurality of rows, which are parallel to each other and extend in a particular direction perpendicular to a conveying direction of a medium, the plurality of nozzles are arranged in a plurality of discharge-nozzle areas arranged in the particular direction, such that the plurality of discharge-nozzle areas cover an entire conveying area of the medium in the particular direction, the instructions, when executed, being arranged to cause a processing arrangement to perform the steps of:

selecting only a first nozzle of the plurality of nozzles from a first row of the plurality of rows;

selecting only a second nozzle of the plurality of nozzles from a second row of the plurality of rows;

discharging the liquid from the first nozzle onto the medium to form a first line comprising a plurality of liquid droplets and extending in the conveying direction and from the second nozzle onto the medium to form a second line comprising a plurality of liquid droplets and extending in the conveying direction immediately adjacent to the first line, wherein a third row of the plurality of rows is positioned between the first row and the second row in the conveying direction, wherein the nozzles arranged in each of the plurality of rows extending in the particular direction are spaced at a constant interval;

determining whether a position of the at least one discharge head corresponds to a desired predetermined position based on a position of the liquid discharged from the first nozzle onto the medium and a position of the liquid discharged from the second nozzle onto the medium, wherein the first row is positioned furthest from the second row among the plurality of rows in the conveying direction;

selecting a third nozzle of the plurality of nozzles from the third row immediately adjacent to the first nozzle in the particular direction;

selecting a fourth nozzle of the plurality of nozzles from a fourth row of the plurality of rows immediately adjacent to the second nozzle in the particular direction; and discharging the liquid from the third nozzle and from the fourth nozzle onto the medium, wherein a particular line intersects at least a portion of the first nozzle, at least a portion of the second nozzle, at least a portion of the third nozzle, and at least a portion of the fourth nozzle, and the fourth row is positioned between the first row and the second row.

11. A printer comprising:

at least one liquid discharge head comprising a nozzle plate, and the nozzle plate has a plurality of nozzles formed therethrough, wherein the plurality of nozzles are configured to discharge a liquid and are arranged in a plurality of rows, which are parallel to each other and extend in a particular direction perpendicular to a conveying direction of a medium, the plurality of nozzles are arranged in a plurality of discharge-nozzle areas arranged in the particular direction, such that the plurality of discharge-nozzle areas cover an entire conveying area of the medium in the particular direction; and a discharge controller configured to:

select only a first nozzle of the plurality of nozzles from a first row of the plurality of rows, select only a second nozzle of the plurality of nozzles from a second row of the plurality of rows, discharge the liquid from the first nozzle onto the medium to form a first line comprising a plurality of liquid droplets and extending in the conveying direction and from the second nozzle onto the medium to form a second line comprising a plurality of liquid droplets and extending in the conveying direction immediately adjacent to the first line, determine whether a position of the at least one discharge head corresponds to a desired predetermined position based on a position of the liquid discharged from the first nozzle onto the medium and a position of the liquid discharged from the second nozzle onto the medium, wherein a third row of the plurality of rows is positioned between the first row and the second row in the conveying direction, wherein the nozzles arranged in each of the plurality of rows extending in the particular direction are spaced at a constant interval, wherein the first row is positioned furthest from the second row among the plurality of rows in the conveying direction, select a third nozzle of the plurality of nozzles from the third row immediately adjacent to the first nozzle in the particular direction, select a fourth nozzle of the plurality of nozzles from a fourth row of the plurality of rows immediately adjacent to the second nozzle in the particular direction, and discharge the liquid from the third nozzle and from the fourth nozzle onto the medium, wherein a particular line intersects at least a portion of the first nozzle, at least a portion of the second nozzle, at least a portion of the third nozzle, and at least a portion of the fourth nozzle, and the fourth row is positioned between the first row and the second row.

* * * * *